US010966486B2

(12) United States Patent
Berberian et al.

(10) Patent No.: US 10,966,486 B2
(45) Date of Patent: Apr. 6, 2021

(54) SHOE WITH A HIGH HEEL TO LOW HEEL CONVERSION

(71) Applicant: High-Low Heel, LLC, Vancouver, WA (US)

(72) Inventors: Maria Mercedes Berberian, Vancouver, WA (US); Allen Nejah, San Jose, CA (US)

(73) Assignee: High-Low Heel, LLC, Vancouver, WA (US)

( * ) Notice: Subject to any disclaimer, the term of this patent is extended or adjusted under 35 U.S.C. 154(b) by 0 days.

(21) Appl. No.: 16/785,192

(22) Filed: Feb. 7, 2020

(65) Prior Publication Data

US 2020/0229541 A1 Jul. 23, 2020

Related U.S. Application Data

(63) Continuation-in-part of application No. PCT/US2018/063226, filed on Nov. 30, 2018, which (Continued)

(51) Int. Cl.
*A43B 3/24* (2006.01)
*A43B 7/14* (2006.01)
(Continued)

(52) U.S. Cl.
CPC ..... *A43B 21/52* (2013.01); *A43B 3/246* (2013.01); *A43B 7/1425* (2013.01); (Continued)

(58) Field of Classification Search
CPC ..... A43B 3/24; A43B 3/242; A43B 3/244; A43B 3/246; A43B 3/248; A43B 3/26; A43B 7/28; A43B 7/1425; A43B 7/1435; A43B 7/1445; A43B 13/1012; A43B 13/141; A43B 13/28; A43B 13/30; (Continued)

(56) References Cited

U.S. PATENT DOCUMENTS 1,234,508 A * 7/1917 Sztari ..... A43B 21/37 36/36 R
1,743,543 A * 1/1930 Gutierrez ..... A43B 21/48 36/42
(Continued)

FOREIGN PATENT DOCUMENTS

GB 408115 A 4/1934
GB 1357033 A 6/1974
GB 2538967 A 7/2016

*Primary Examiner* — Joshua E Rodden
(74) *Attorney, Agent, or Firm* — Kolitch Romano LLP

(57) ABSTRACT

A convertible shoe may include a sole and a plurality of interchangeable heel portions, each selectively attachable to the sole. The heel portions may each include a mounting surface configured to interface with a heel receiver of the sole. The heel receiver may include a fixed hook and a movable hook, with the movable hook being operable by an actuator coupled to a bottom surface of the sole. In some examples, an upper is secured to the sole of the shoe by one or more clamping plates. In some examples, the sole of the shoe is configured to be biased into a default bend corresponding to a high-heeled state even when a low heel is attached to the heel receiver.

37 Claims, 37 Drawing Sheets

Related U.S. Application Data is a continuation of application No. 16/056,425, filed on Aug. 6, 2018, now Pat. No. 10,426,225, which is a continuation-in-part of application No. 15/879,391, filed on Jan. 24, 2018, now Pat. No. 10,039,340.

(51) Int. Cl.

| | |
|---|---|
| ***A43B 13/14*** | (2006.01) |
| ***A43B 13/30*** | (2006.01) |
| ***A43B 13/34*** | (2006.01) |
| ***A43B 13/36*** | (2006.01) |
| ***A43B 13/41*** | (2006.01) |
| ***A43B 21/38*** | (2006.01) |
| ***A43B 21/39*** | (2006.01) |
| ***A43B 21/47*** | (2006.01) |
| ***A43B 21/51*** | (2006.01) |
| ***A43B 21/52*** | (2006.01) |
| ***A43B 21/37*** | (2006.01) |

(52) U.S. Cl.

CPC ..... *A43B 7/1435* (2013.01); *A43B 7/1445* (2013.01); *A43B 13/141* (2013.01); *A43B 13/30* (2013.01); *A43B 13/34* (2013.01); *A43B 13/36* (2013.01); *A43B 13/41* (2013.01); *A43B 21/37* (2013.01); *A43B 21/38* (2013.01); *A43B 21/39* (2013.01); *A43B 21/47* (2013.01); *A43B 21/51* (2013.01)

(58) Field of Classification Search

CPC ..... A43B 13/32; A43B 13/34; A43B 13/36; A43B 13/41; A43B 21/36; A43B 21/37; A43B 21/38; A43B 21/39; A43B 21/40; A43B 21/42; A43B 21/433; A43B 21/47; A43B 21/51; A43B 21/52

USPC ..... 36/15, 42, 100, 107, 108

See application file for complete search history.

(56) References Cited

U.S. PATENT DOCUMENTS

| | | | | |
|---|---|---|---|---|
| 1,829,252 | A * | 10/1931 | Zubia | A43B 21/36 36/42 |
| 2,258,265 | A | 10/1941 | Schwartz | |
| 2,607,133 | A * | 8/1952 | Marlowe | A43B 3/24 36/11.5 |
| 2,943,404 | A | 7/1960 | Sultan | |
| 3,890,725 | A * | 6/1975 | Lea | A43B 3/246 36/11.5 |
| 4,670,996 | A | 6/1987 | Dill | |
| 4,805,320 | A | 2/1989 | Goldenberg et al. | |
| 5,133,138 | A | 7/1992 | Durcho | |
| 5,456,026 | A * | 10/1995 | Lewis | A43B 1/0054 36/36 R |
| 9,289,025 | B2 | 3/2016 | Damodar | |
| 9,326,565 | B1 | 5/2016 | Davis | |
| 9,510,647 | B1 * | 12/2016 | Singh | A43B 21/38 |
| 9,775,400 | B2 | 10/2017 | Chang et al. | |
| 9,883,713 | B2 * | 2/2018 | Kawakami | A43B 3/244 |
| 9,936,761 | B2 * | 4/2018 | Alan | A43B 21/36 |
| 10,143,261 | B2 * | 12/2018 | Perkins | A43B 1/0054 |
| 2006/0075662 | A1 * | 4/2006 | Schupbach | A43B 21/36 36/100 |
| 2013/0067770 | A1 * | 3/2013 | Sherwood | A43B 21/39 36/100 |
| 2016/0073725 | A1 * | 3/2016 | Guenoun | A43B 13/36 36/100 |
| 2017/0042276 | A1 | 2/2017 | Alan | |
| 2017/0095029 | A1 | 4/2017 | Berberian | |
| 2017/0156441 | A1 | 6/2017 | Ho | |

* cited by examiner

FIG. 1
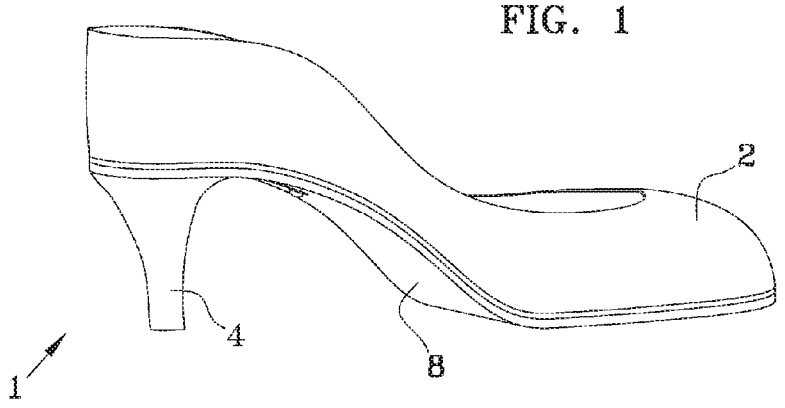
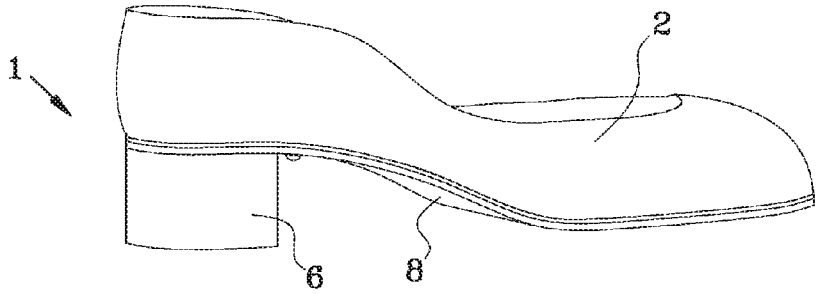
FIG. 2

SHOE WITH A HIGH HEEL TO LOW HEEL CONVERSION

FIELD

This disclosure relates to footwear. More specifically, the disclosed embodiments relate to systems and methods for converting shoes and other footwear between high-heel and low-heel configurations.

INTRODUCTION

Style and comfort do not always go hand in hand. This is especially true when it comes to women's footwear. High heels, though a mainstay in most women's closets, fall short of being reasonably designed footwear. The height difference between the front and rear of these shoes causes wobbling and slipping even on unadorned, planar surfaces. Despite this, women continue to wear these fashion statements even though the original purpose of high heels, that of helping a rider secure their stance in the stirrups so they could shoot arrows more effectively from horseback, no longer exists. Through the years, high heels evolved into stilettos and pumps and have succumb to iconic branding such that many see such shoes as status symbols for success and perhaps femininity.

Unfortunately, continued use of elevated footwear leads to a plethora of physical problems manifesting itself in such things as planter fasciitis and neuroma while affecting other areas of the body such as the calves, knees and lower back. The American Podiatric Medical Association reports that women have four times as many foot issues as do men. High heels are dangerous to walk in and are subject to immediate frictional engagement with sidewalk grates and the like. The most common complaint about high heels is that they are slow and uncomfortable to walk in. For this reason, many working women carry a second pair of shoes, ones with a low heel or a shoe of a walking/running variety, to get them to and from the workplace. Since shoes accumulate dirt in use, this strategy not only requires one to carry a second set of shoes, it also requires a bag in which to transport them. For most women who carry a purse, this means both arms are full. The situation is worsened if there is a personal computing device such as a laptop computer or tablet that also must be transported daily to work.

Accordingly, a single pair of shoes that could be converted between a fashionable high and a comfortable low heel would fulfill a long felt need in the footwear industry. This new invention utilizes and combines known and new technologies in a unique and novel configuration to develop a convertible shoe that overcomes the aforementioned problems and provides a solution to a common workplace dilemma.

SUMMARY

The present disclosure provides systems, apparatuses, and methods relating to convertible footwear.

Features, functions, and advantages may be achieved independently in various embodiments of the present disclosure, or may be combined in yet other embodiments, further details of which can be seen with reference to the following description and drawings.

BRIEF DESCRIPTION OF THE DRAWINGS

FIG. 1 is a side perspective view of an illustrative convertible shoe in a high heeled mode.

FIG. 2 is a side perspective view of an illustrative convertible shoe in a low heeled mode.

DETAILED DESCRIPTION

Figure 3:
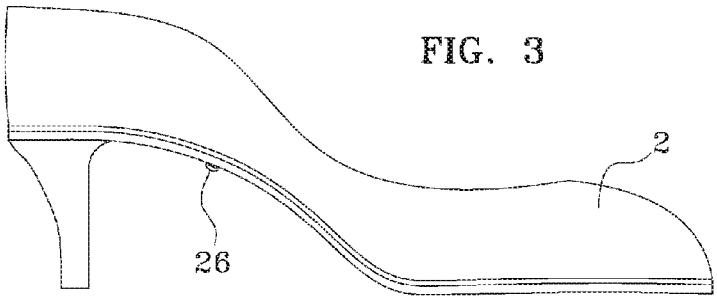
FIG. 3 is a side view of the convertible shoe in the high heeled mode.
Figure 4:
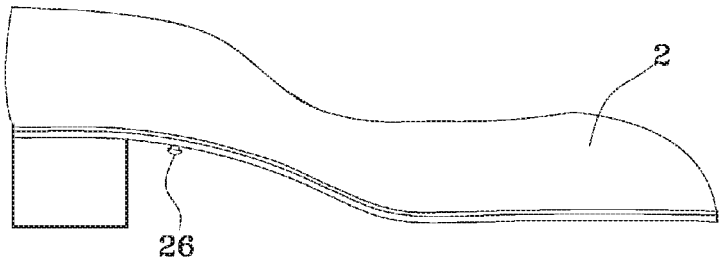
FIG. 4 is a side view of the convertible shoe in the low heeled mode.

Various aspects and examples of a shoe that is convertible between high-heel and low-heel modes, as well as related methods, are described below and illustrated in the associated drawings. Unless otherwise specified, a convertible shoe in accordance with the present teachings, and/or its various components may, but are not required to, contain at least one of the structures, components, functionality, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Illustrative Combinations and Additional Examples; (5) Advantages, Features, and Benefits; and (6) Conclusion. The Examples, Components, and Alternatives section is further divided into subsections A through G, each of which is labeled accordingly.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"Resilient" describes a material or structure configured to be deformed elastically under normal operating loads (e.g., when compressed) and to return to an original shape or position when unloaded.

"Rigid" describes a material or structure configured to be stiff, non-deformable, or substantially lacking in flexibility under normal operating conditions.

"AKA" means "also known as," and may be used to indicate an alternative or corresponding term for a given element or elements.

Directional terms, such as "inboard," "outboard," "front," and "rear" (and the like) are intended to be understood in the context of the article of footwear on or in which components described herein may be mounted or otherwise attached. For example, "outboard" may indicate a relative position that is laterally farther from the centerline of a shoe, or a direction that is away from the shoe's longitudinal centerline. Conversely, "inboard" may indicate a direction toward the centerline, or a relative position that is closer to the centerline. Similarly, "forward" or "front" means toward the toe portion of the footwear, and "rear" or "back" means toward the heel portion of the footwear. Similarly, the term "longitudinal" generally refers to the heel-to-toe (length) direction of the footwear, while the term "lateral" generally refers to the side-to-side (width) direction of the footwear. In the absence of a host article of footwear, the same directional terms may be used as if the article were present. For example, even when viewed in isolation, a component may have a "forward" side, based on the fact that the component would be installed with the side in question facing in the direction of the toe portion of a shoe.

"Coupled" means connected, either permanently or releasably, whether directly or indirectly through intervening components.

The following terms relate to portions of a shoe or other article of footwear:

a. Breast: The forward facing part of the heel, under the arch of the sole.

b. Feather: The part of the shoe where the upper's edge meets the sole.

c. Heel: The part of the sole that raises the rear of the shoe in relation to the front.

d. Heel Cap: The part of the heel that contacts the ground. Also called the top piece.

e. Insole: A layer of material that sits inside the shoe that creates a layer between the outsole (or any intervening soles e.g. midsole) and the wearer's foot.

f. Outsole: The exposed part of the sole that is contact with the ground.

g. Seat: Where the heel of the foot sits in the shoe.

h. Shank: A piece of rigid material inserted somewhere between the outer face of the sole and the inner face of the insole, to as to cause the sole assembly to lie against the arch of the foot.

i. Sole Assembly: The part of the shoe that sits below the wearer's foot. The upper, sole, and heel make up the whole of the shoe.

j. Upper: The part of the shoe that covers the foot.

k. Welt: A strip of material that joins the upper to the sole. It may also be the midsole or eliminated in certain shoe designs.

Overview

When one shifts from walking on low heels to high heels the foot bends at the metatarsophalangeal joints located between the base of the proximal phalanx bones and the head of the metatarsal bones. The plantar fascia is then stretched beneath the tarsal bones. Thus, less of the weight of the person is carried by the calcaneus bone and more of the weight is carried by the metatarsal bones. Like walking on tip toes, this leaves this plantar fascia under tension. Over periods of time, this tension fatigues the foot, For this reason, high heeled shoes generally have a support shank made of a rigid material that runs down the longitudinal centerline of the shoe to transfer some of the load off of the heads of the metatarsal bones and back onto the remainder of the foot's bone structure. The support shank also generally has a slight arc along its length that serves to flex the plantar fascia slightly and reduce the point stress at its center. In normal walking, whether in high heels or low heels, the foot must flex and bend at the metatarsophalangeal joint. For this reason (to allow the flexing of the shoe with the foot) the support shank's proximal end begins somewhere behind the base of the proximal phalanx bones and its distal end terminates somewhere under the calcaneus bone. For obvious reasons this support shank must both be thin (to keep the thickness of the outsole/midsole/insole assembly to a minimum) and lightweight (to keep leg fatigue to a minimum). In a high heeled shoe the proximal end of the support shank begins just behind the base of the proximal phalanx bones, while in a low heeled shoe, the proximal end of the support shank is located further away from the base of the proximal phalanx bones and the distal end is located closer to the back of the calcaneus bone. So when walking in low heels the support shank shifts some of the load from the front of the foot and when walking in high heels the support shank shifts some of the load from the back of the foot. It also helps the shoe keep its overall shape, so that the heel cap meets the ground evenly across its face.

The longitudinal arc that the support shank traces varies with the shoe design and the height of the heel. Without the support shank the shoe may quickly break down and walking may become tedious and uncomfortable. Support of the foot may be moved more forward (toward the metatarsophalangeal joints) as the height of the heel increases to properly support both the foot and the shoe's body. For this reason the structural design of high heeled shoes and low heeled shoes can require different internal placements of the support shank.

In general, convertible footwear as disclosed herein may include a heel attachment mechanism that allows heel portions to be easily interchanged by the user, thereby converting the footwear between high-heel and low-heel configurations or modes. As discussed above, a support shank (also referred to as a support and/or a stiffener) is present in some examples of the present disclosure, and this support shank is at least partially movable with respect to one or more remaining portions of the shoe. Furthermore, the movable support shank may be locked into selected positions (e.g., a forward position and a rearward position) by a locking mechanism that passes through the sole of the shoe and ensures the selected position is maintained during use. In some examples, the locking mechanism is externally accessible. In some examples, at least part of the locking mechanism is integrated into the interchangeable heel portions.

EXAMPLES, COMPONENTS, AND ALTERNATIVES

The following sections describe selected aspects of exemplary convertible shoes, as well as related systems and/or methods. The examples in these sections are intended for illustration and should not be interpreted as limiting the entire scope of the present disclosure. Each section may include one or more distinct embodiments or examples, and/or contextual or related information, function, and/or structure.

A. First Illustrative Convertible Shoe

As shown in FIGS. 1-11, this section describes an illustrative convertible shoe 1. Shoe 1 is an example of the convertible shoe described in the Overview above.

Figure 5:
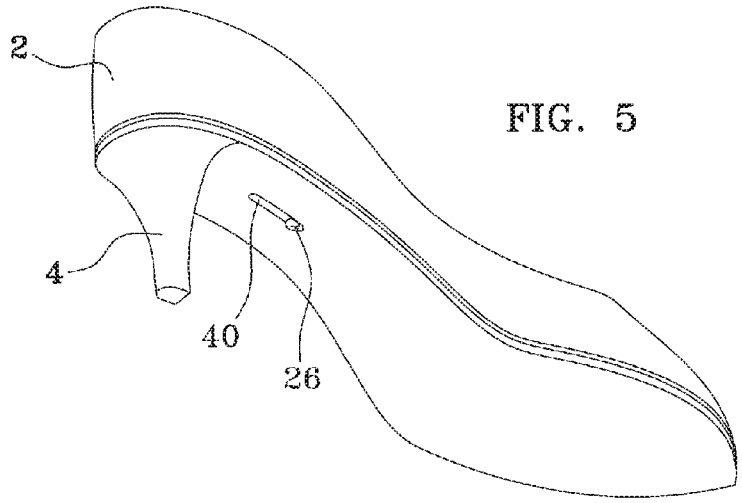
FIG. 5 is a bottom perspective view of the convertible shoe in the high heeled mode.
Figure 6:
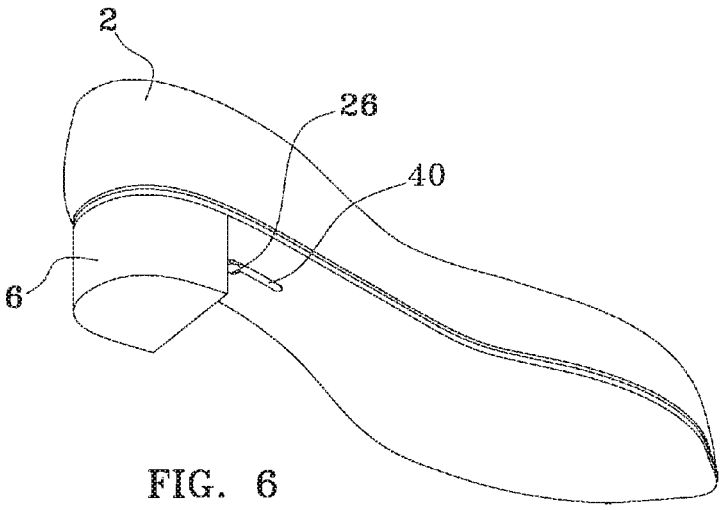
FIG. 6 is a bottom perspective view of the convertible shoe in the low heeled mode.
Figure 7:
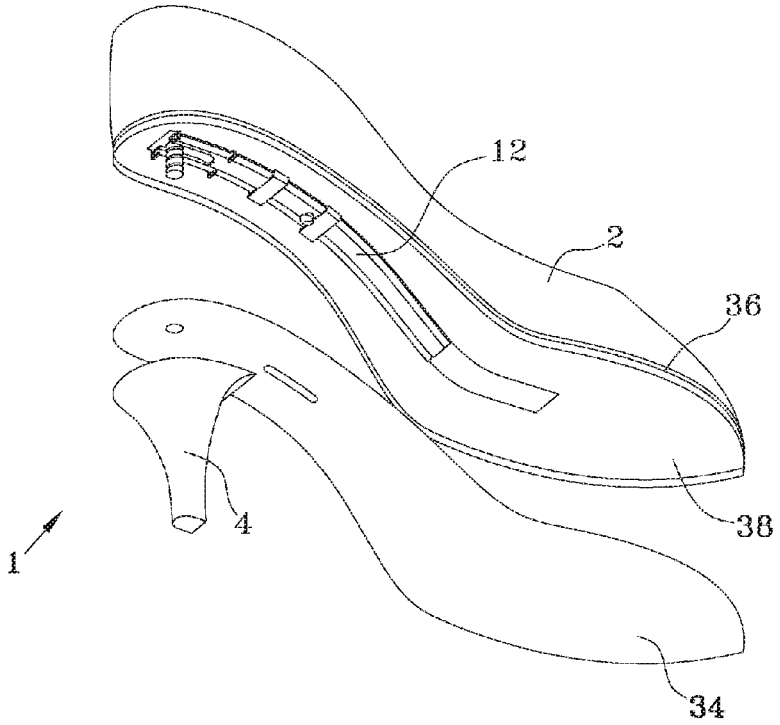
FIG. 7 is a bottom perspective exploded view of the convertible shoe in the high heeled mode.

Looking at FIGS. 1, 3, and 5, the general outward appearance of convertible shoe 1 in a high-heeled mode can best be seen. Looking at FIGS. 2, 4, and 6, the general outward appearance of convertible shoe 1 in a low-heeled mode can best be seen.

Convertible shoe 1 has an upper 2, a sole assembly 8, and a lockable sliding shank assembly 12 (see FIG. 7), a shank locking means, a removable high heel 4, a removable low heel 6, and a heel locking means 14. Heels 4 and 6 are interchangeable and utilize the same locking means for securement to the shoe. Upper 2 is lasted may be affixed to sole assembly 8 as per conventional shoe fabrication methodology.

Lockable sliding shank assembly 12 includes a rigid shank 14, a track 16, and a shank locking means. Generally, these will each comprise a rigid material, such as a metal (e.g., steel) or a polymer. Looking at FIG. 9, it can be seen that shank 16 in this example is a linear, curved member, contoured for sliding operation tracing the arch of the specific shoe it is mated to. Although shank 16 may simply be a solid steel bent plate, in a preferred embodiment shank 16 is of a thinner fabrication and has a nonlinear axial cross section. This corrugated style configuration adds strength with a reduction in weight. Taking into consideration FIGS. 9, 10, and 11 together, it is understood that shank 16 has a central raised rib 20 flanked on either side by a depressed flange 22. Extending normally from the central rib 20 is the shank locking means, which in the preferred embodiment is a threaded stud 24 that threadingly engages the internal thread on locking lever 26. Locking lever 26 has a widened head with a flange 28 extending therefrom. In alternate embodiments there is a plethora of other styles and types of locking mechanisms that may be used with or separately from the lever.

Track 16 may take different structural configurations. However, in the preferred embodiment it resembles a "T" track. Depressed flanges 22 reside under the edges of track 16, and serve as the sliding contact interface between shank 14 and track 16. The track may be affixed in sole assembly 8 by gluing, stitching, mechanical fastening (see provided orifices 30), and/or the like. The ends of track 16 have caps 32, under which the distal or proximal ends of shank 14 reside when the shoe is in the high-heeled or low-heeled configuration. This mechanically prevents any separation between shank 14 and track 16 at their ends, functionally strengthening sliding shank assembly 12 during walking.

Figure 8:
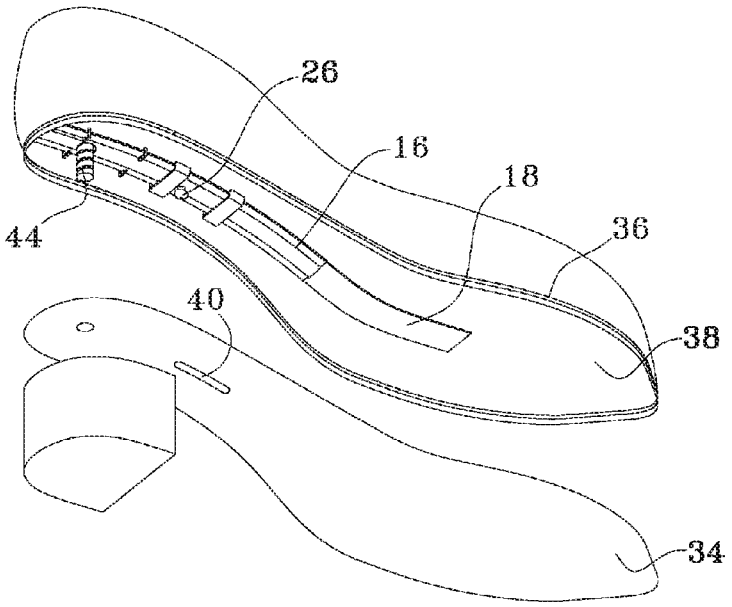
FIG. 8 is a bottom perspective exploded view of the convertible shoe in the low heeled mode.
Figure 9:
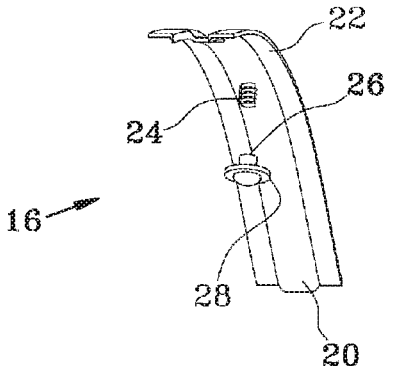
FIG. 9 is a front perspective of an illustrative sliding support shank showing a locking/adjustment lever.
Figure 10:
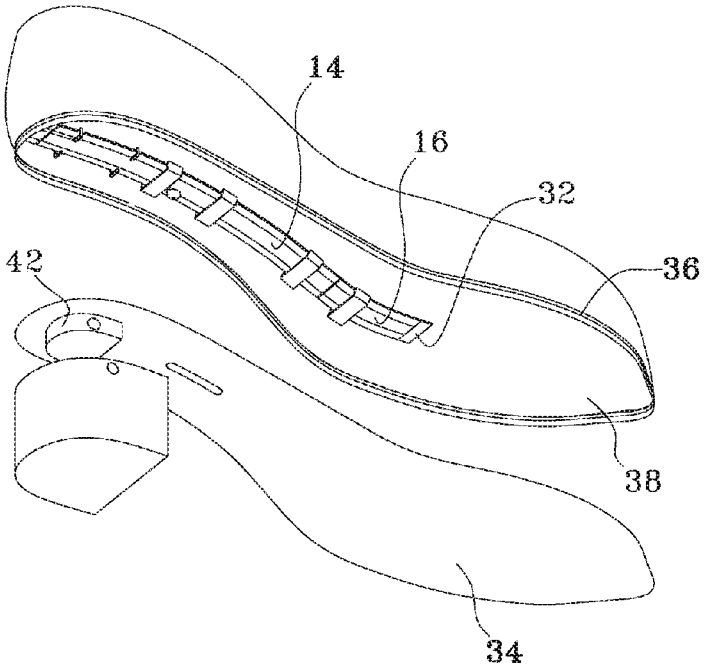
FIG. 10 bottom perspective exploded view of the convertible shoe in the low heeled mode with an alternate heel locking mechanism.
Figure 11:
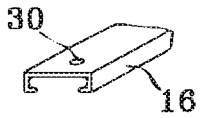
FIG. 11 is a perspective view of an illustrative support shank track.

Looking at FIG. 8, sole assembly 8 includes an outer sole 34 and an inner sole 36 bonded together, and may optionally contain a midsole 38 (or a welt) bonded on one of its faces to outer sole 34 and bonded on its other face to inner sole 36, so as to join the inner sole, midsole and outer sole into the sole assembly 8. In a preferred embodiment, track 16 and shank 14 reside in midsole 38, although as discussed herein, their placement will vary within sole assembly 8 depending on the shoe's design. Outer sole 34 has a slot 40 through which threaded stud 24 can pass to threadingly engage locking lever 26.

Sole assembly 8 may attach to either heel by any suitable method. Two such methods are discussed and illustrated herein. In a preferred embodiment (see FIG. 10) outer sole 34 has a raised detent 42 that conforms to a matingly conforming depression formed in the top of the heel. Both the heel and raised detent 42 have orifices therein that align upon assembly to accept a locking pin. In some embodiments (see FIG. 10), a threaded pin 44 that passes through an aligned orifice in outer sole 34 matingly engages a threaded recess in the heel. Similar style bayonet pins/fittings may be substituted.

In some embodiments, depending on the materials and design of sole assembly 8, track 16 may be eliminated and replaced by a groove 18 (see FIG. 8) partially or fully formed in the outsole, midsole, insole, or any combination thereof. This track will be sized to allow for the sliding, lockable movement of shank 14 therein. Generally the elimination of the track and substitution of a groove works well with thicker sole assemblies 8 made of very resilient materials.

In operation, the wearer selects the high-heel mode or the low-heel mode. If the low-heeled mode is desired, low heel 6 is affixed over raised detent 42, and a locking pin is inserted into the aligned orifices. Locking lever 26 is slid toward the back (heel side) of shoe 1. This causes shank 14 to slide in track 16 until the distal end of the shank reaches the distal end of track 16 and resides under the rear cap (not visible in the perspective drawings of FIGS. 8 and 10). Shank locking lever 26 is then screwed down tight such that its flange 28 frictionally engages outer sole 34, securing shank 14 in the low heel position. (Although it is to be noted that the action of walking, once the appropriate heel for the shank position button is installed, acts to keep the shank 14 in its position. The locking feature of lever 26 is a redundant feature and need not be utilized in all embodiments.) To switch to the high-heeled mode, the heels are swapped by the reverse process, lever 26 is unlocked and slid toward the front (toe side) of shoe 1, until the proximal end of shank 14 resides under front cap 32. Lever 26 is screwed tight.

The process as described for the low-heeled mode moves shank 26, resulting in the shoe's arch support shifting from under the metatarsophalangeal joints further back in shoe 1, under the calcaneus bone so as to allow more of the weight to be carried by the metatarsal bones and supporting the middle of the plantar fascia. Many styles of shoes incorporate the thickness of the sole into the design "look" and use platforms (thick midsoles), while other styles focus on minimalism and keep the sole to a minimal thickness, eliminating any midsoles. For this reason, although the preferred embodiment illustrates support shank track 16 and support shank 14 in midsole 38, they may alternately be located in insole 36 or outsole 34, or in any combination of the three sole parts.

In a similar manner, the system/mechanism for swapping the high and low heels will be dictated by the design of the shoe. While illustrated with a simple threaded centrally located pin 44, other suitable heel locking devices may be utilized (e.g., locking plates, dovetailed bases, moveable pins, bayonet fittings, and/or the like).

B. Second Illustrative Convertible Shoe

As shown in FIGS. 12-22, this section describes an illustrative convertible shoe 100. Shoe 100 is another example of the convertible shoe described in the Overview above.

Figure 12:
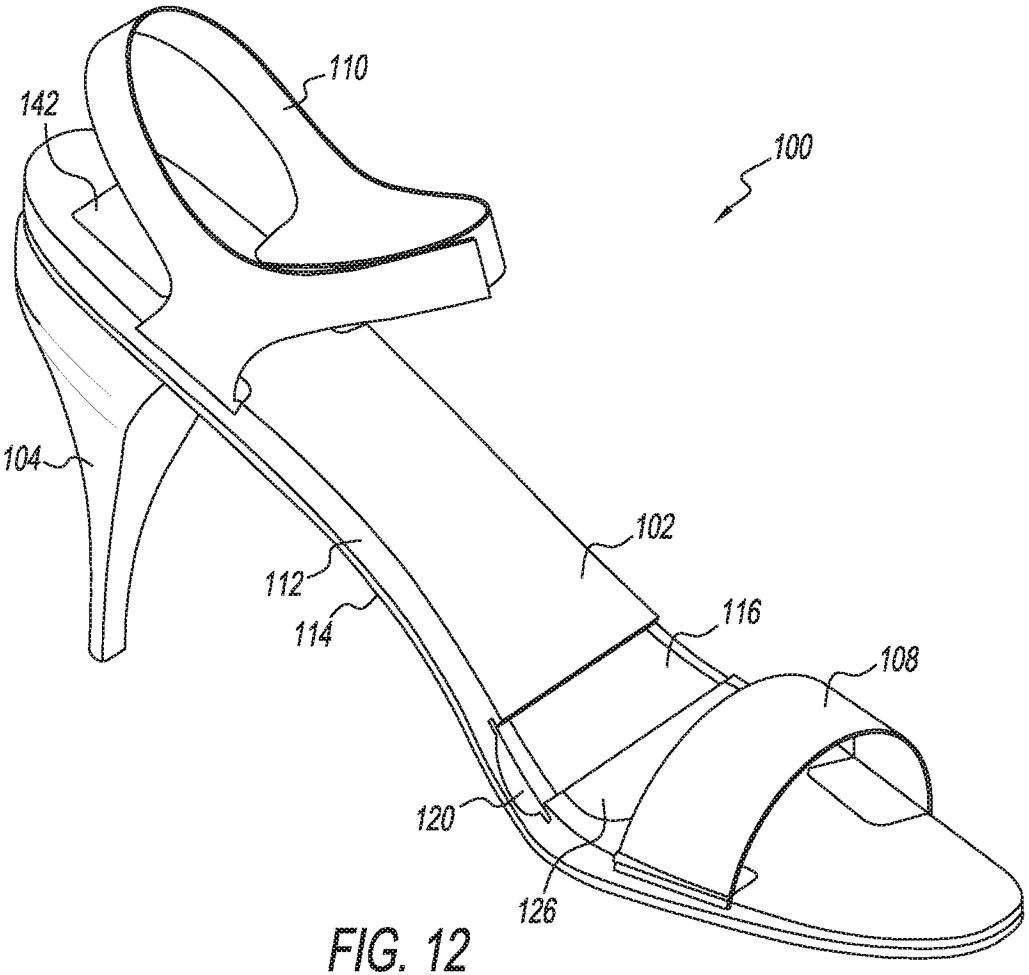
FIG. 12 is an isometric view of another illustrative convertible shoe in a high heeled mode.
Figure 13:
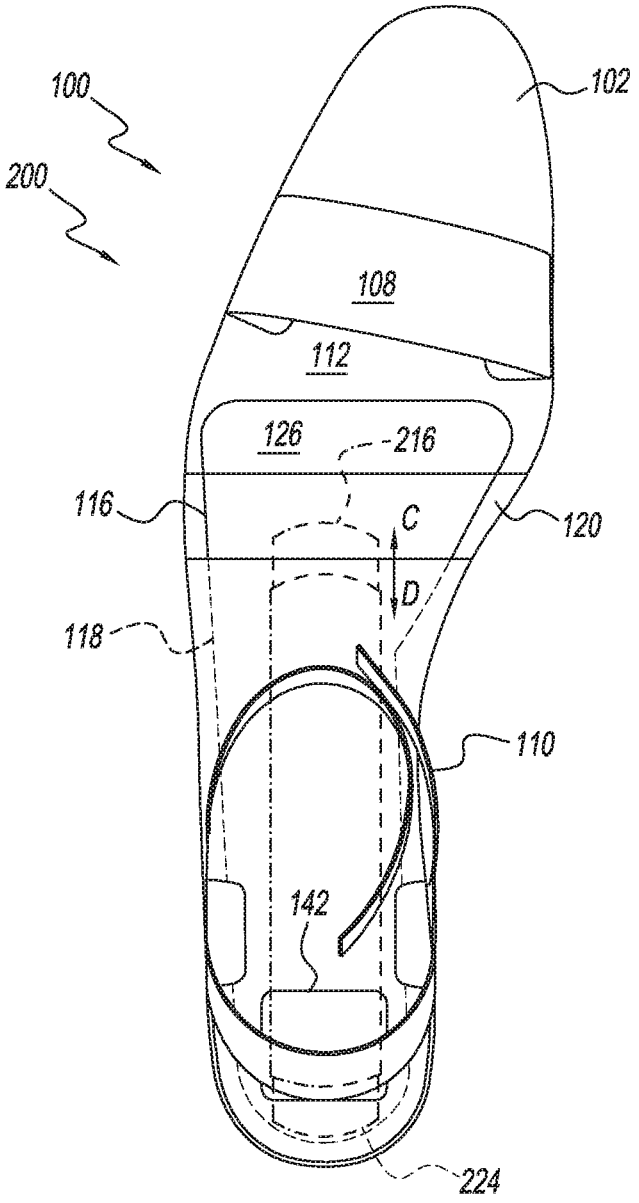
FIG. 13 is a top plan view of the shoe of FIG. 12.
Figure 14:
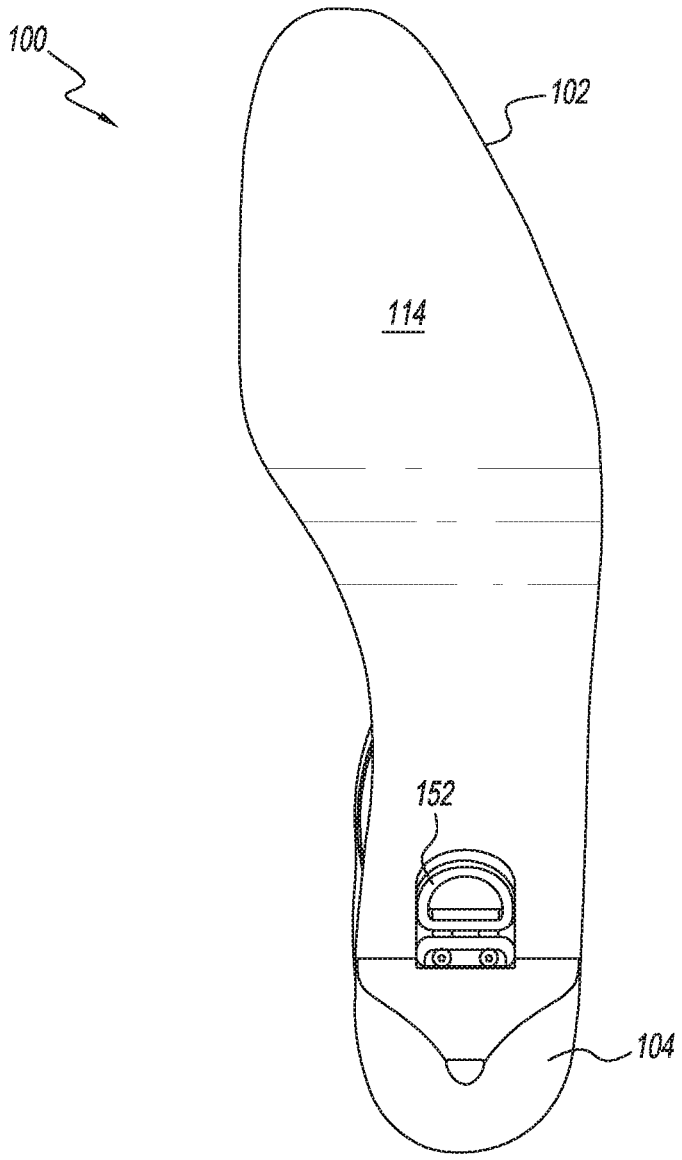
FIG. 14 is a bottom plan view of the shoe of FIG. 12.
Figure 15:
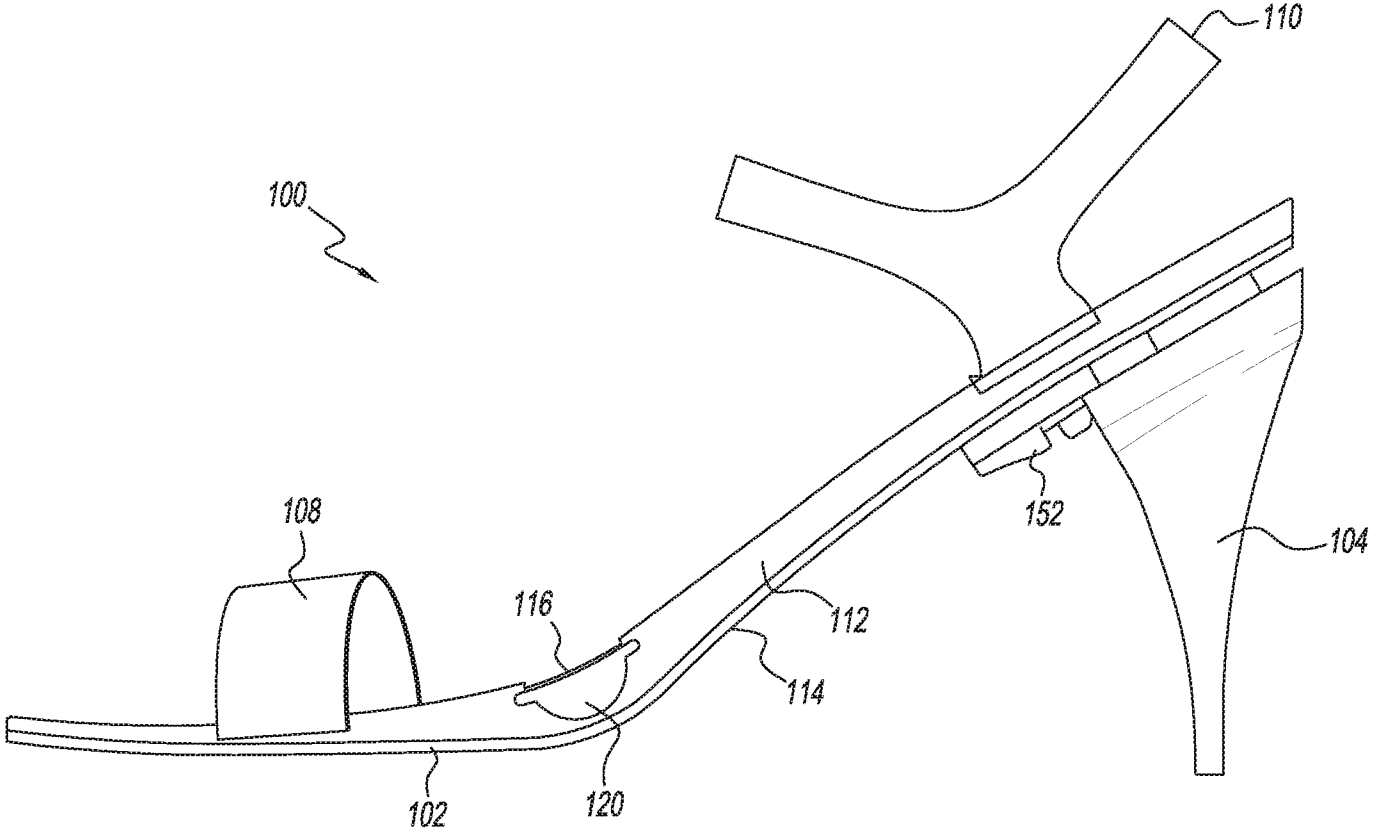
FIG. 15 is a left side elevation view of the shoe of FIG. 12.
Figure 16:
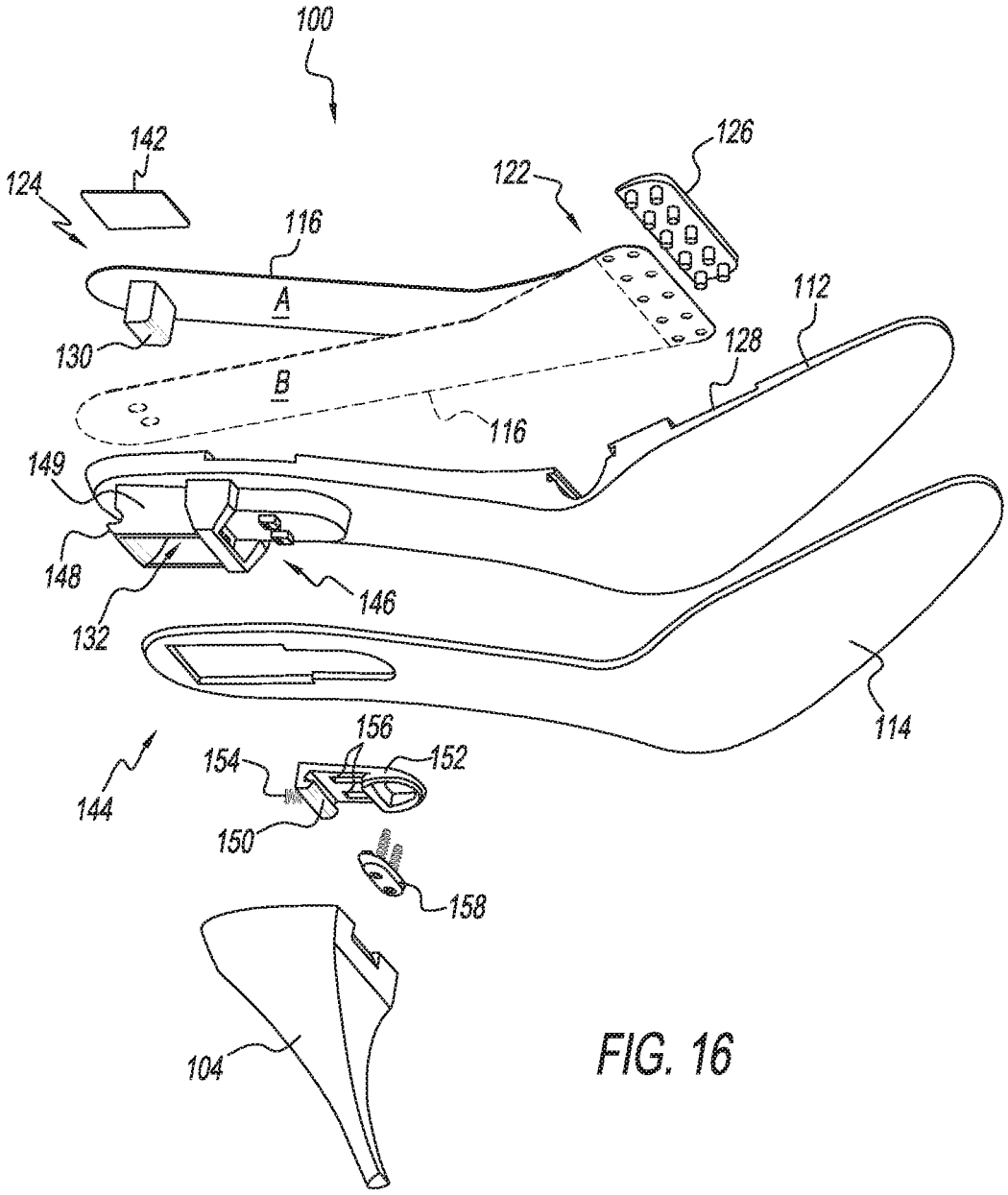
FIG. 16 is a first exploded view of the shoe of FIG. 12.
Figure 17:
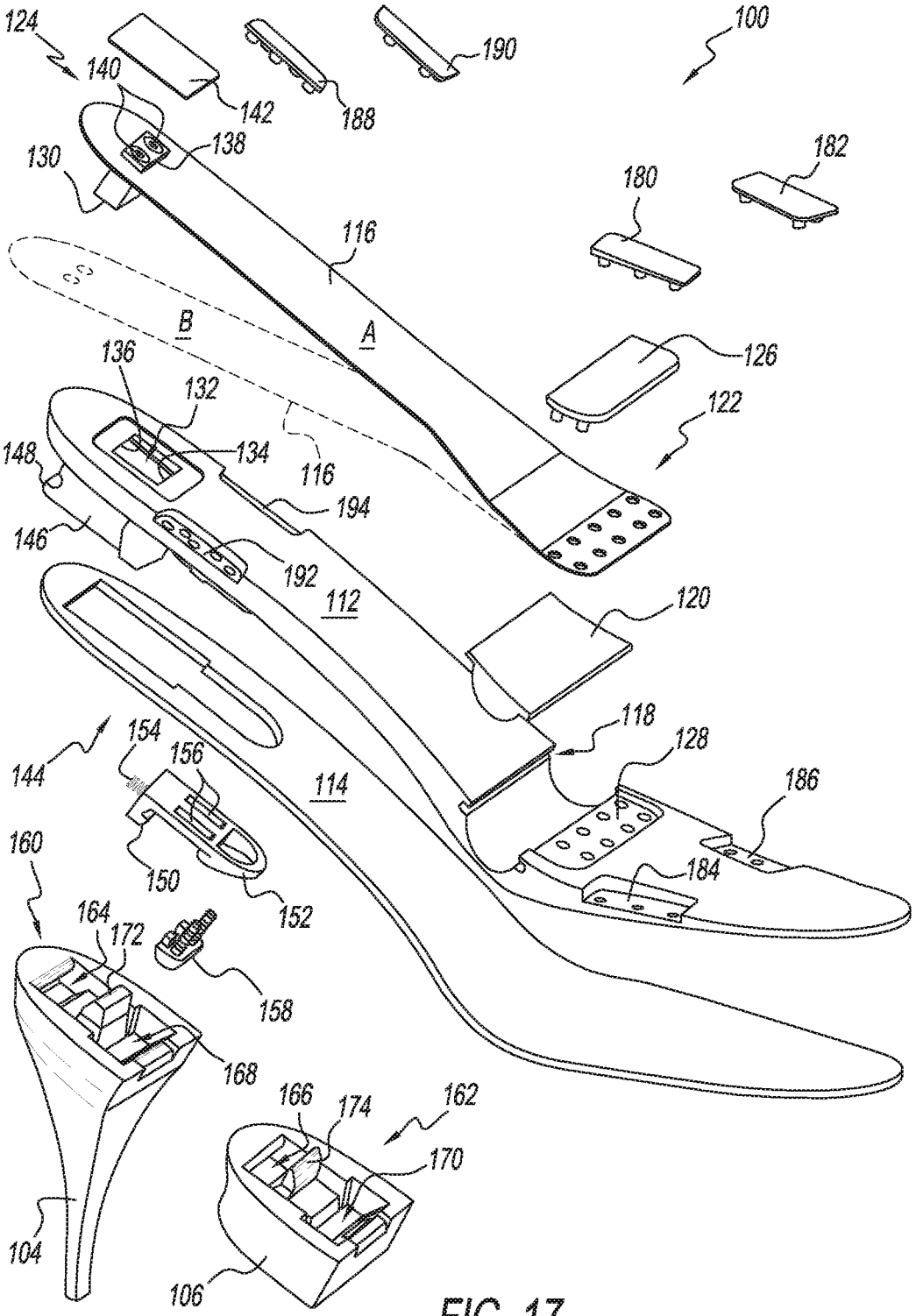
FIG. 17 is a second exploded view of the shoe of FIG. 12.
Figure 18:
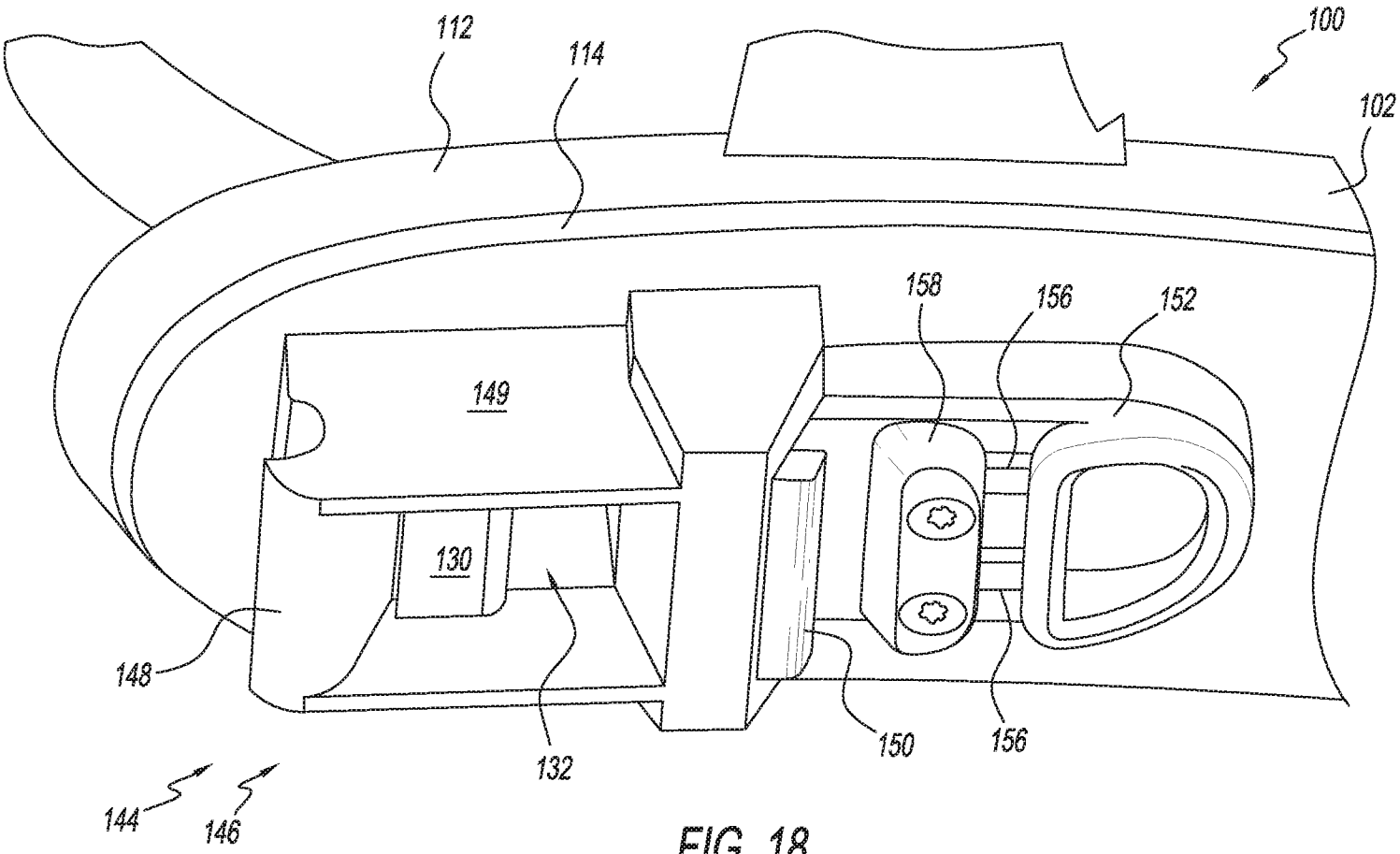
FIG. 18 is a magnified isometric view of a heel receiver portion of the shoe of FIG. 12.
Figure 19:
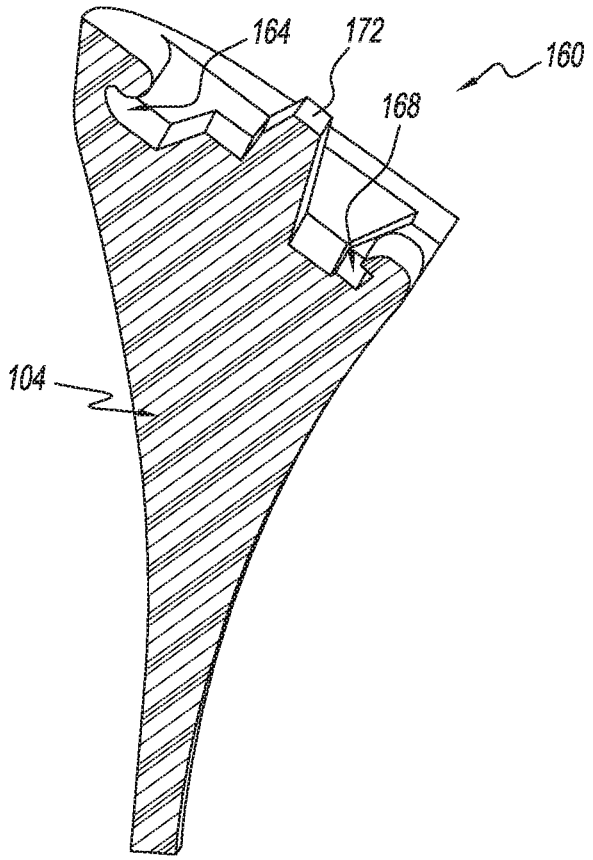
FIG. 19 is a sectional view of an illustrative high heel portion suitable for use with the shoe of FIG. 12.
Figure 20:
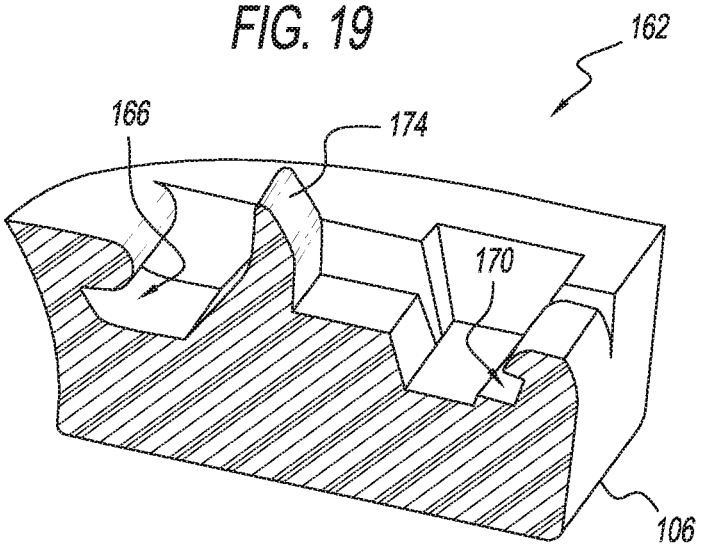
FIG. 20 is a sectional view of an illustrative low heel portion suitable for use with the shoe of FIG. 12.
Figure 21:
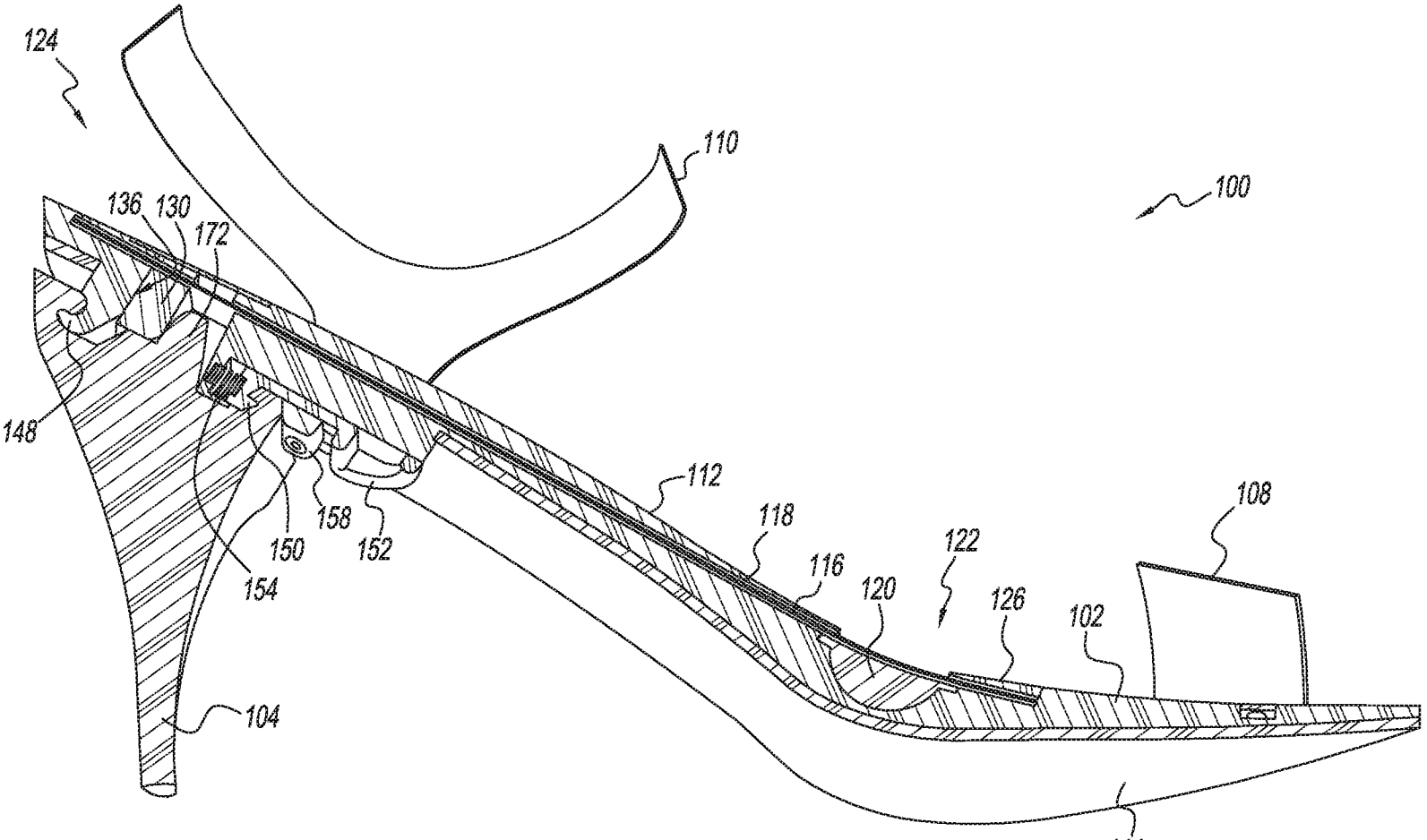
FIG. 21 is a sectional view of the shoe of FIG. 12, in the high heeled mode.
Figure 22:
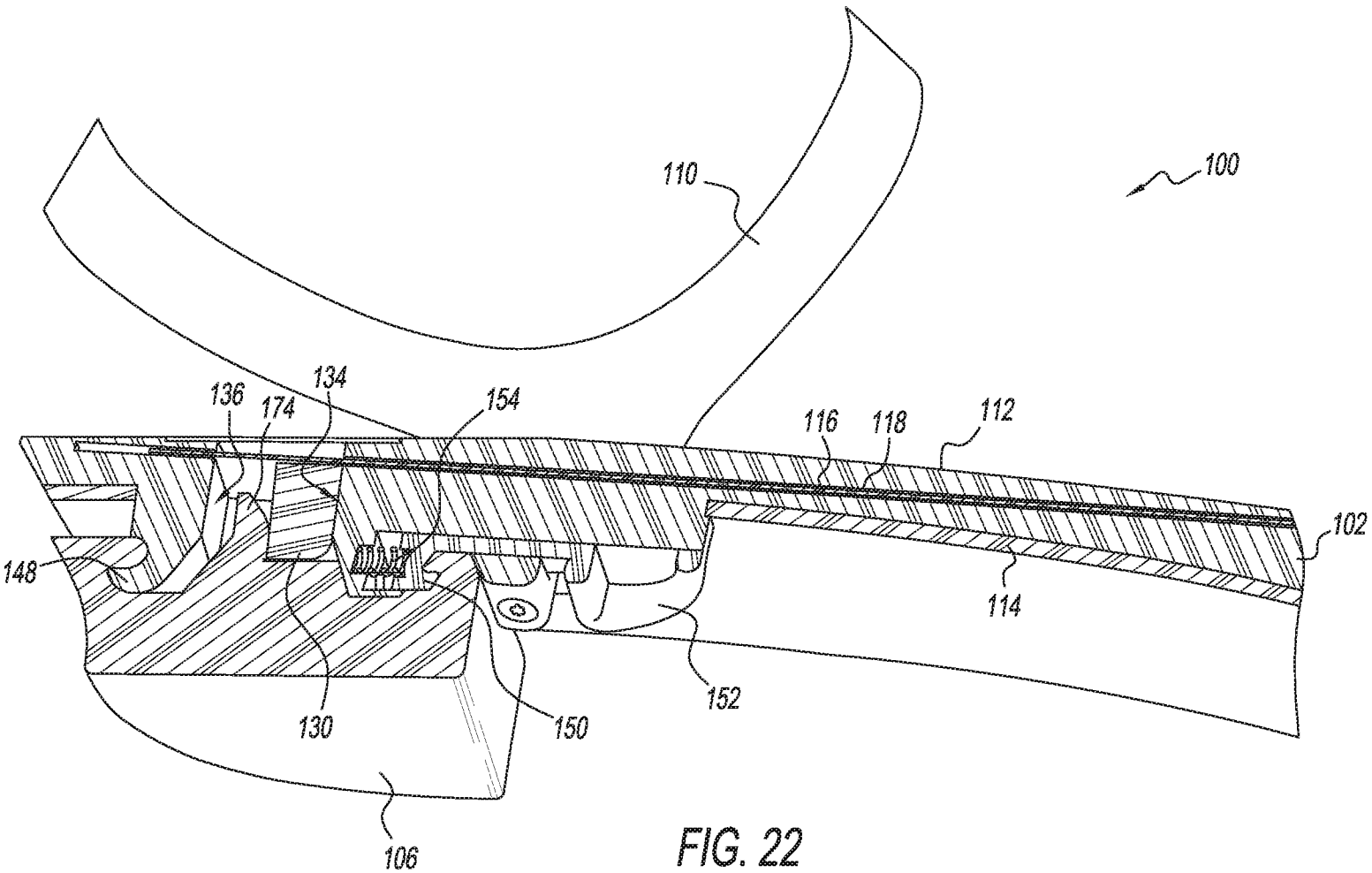
FIG. 22 is a partial sectional view of the shoe of FIG. 12, in a low heeled mode.

Shoe 100 is depicted in an orthogonal view in FIG. 12, a top plan view in FIG. 13, a bottom plan view in FIG. 14, and a side view in FIG. 15. FIGS. 16 and 17 depict exploded views of various components of shoe 100. FIG. 18 is a magnified view of a heel receiver portion of the shoe, and FIGS. 19 and 20 are sectional views of two different heel portions suitable for use with shoe 100. FIG. 21 is a sectional view of the assembled shoe, showing how the heel portion of FIG. 19 attaches to the heel receiver, and FIG. 22 is a partial sectional view showing a similar connection between the heel portion of FIG. 20 and the heel receiver. Although this example refers to a shoe, the features of the present disclosure can be used with any suitable article of footwear, e.g., boots, shoes, sandals, etc.

Shoe 100 includes a sole 102 and a number of interchangeable heel portions that are releasably securable to the sole. In the present example, shoe 100 includes a high heel portion 104 and a low heel portion 106, also referred to as a tall heel portion and a short heel portion, respectively. Shoe 100 may also include an upper, as described above with respect to shoe 1, or any other suitable portion configured to hold a foot of the user. For example, shoe 100 includes a toe strap 108 and a heel strap 110, affixed to the sole and optionally adjustable to fit the foot. More or fewer straps may be utilized.

Sole 102 includes an insole portion 112 generally layered atop an outsole portion 114. As described above, the insole and outsole may comprise any suitable materials, and may be affixed together using known methods. In some examples, however, sole 102, including both insole portion 112 and outsole portion 114, may be generated in a single process, such as multi-material 3-D printing, in which the sole is built in an additive manufacturing process. In general, outsole portion 114 may include a tougher, less resilient material than insole portion 112, e.g., for wear-resistance. Insole portion 112 may include a softer, more resilient material, e.g., for comfort. In some examples, sole 102 may include more or fewer layers.

A support shank 116 is housed at least partially within a pocket or cavity 118 formed in sole 102. Because the support shank and sole may be made of different materials, and because relative movement between the support and the sole may be desirable, support shank 116 and sole 102 are at least partially movable relative to each other. In other words, at least some portion (in some examples, the entirety) of the support shank is free to slide longitudinally with respect to the sole. In some embodiments, it may be more useful to consider that the sole is at least partially free to move with respect to the support shank, as described further below. Support shank 116 is analogous to support shank 14, described above, and has similar functionality. Support shank 116 may include any suitable materials, such as steel (e.g., spring steel). In the present example, support shank 116 may have a degree of flexibility rather than being completely rigid. This is best seen in FIGS. 16 and 17, where an example of a high-heel configuration A and a low-heel configuration B of the support are both depicted.

In this example, cavity 118 is formed entirely in insole portion 112, as best indicated in FIG. 21. However, other suitable configurations may be utilized. For example, cavity 118 may be formed between insole 112 and outsole 114, or partially in each. Shoe 100 further includes an flexible insert portion 120, which lies under support shank 116 proximate a bend in shoe 100 where additional flex and softer support may be needed for the ball of the foot.

In the example of shoe 100, a front end portion 122 of support 116 is secured to sole 102, such that a longitudinal position of the front end portion of the support shank is fixed relative to the sole. A rear end portion 124 of the support remains freely movable within cavity 118. Front end portion 122 of support 116 may be secured by any suitable structure or device. Here, a clamp plate 126 is utilized to secure front end portion 122 to a clamp plate receiver 128 of insole 112. As depicted, for example, in FIG. 17, a plurality of pins in clamp plate 126 pass through corresponding apertures in front end portion 122 and into receiving holes in receiver 128 to secure the support to the insole. Alternatively or additionally, other securing methods may be utilized, such as adhesives, bonding, and/or the like. As described, for example, in Sections A and C, some embodiments of the convertible shoes described herein do not include securing front end portion 122 to sole 102 (i.e., in some examples, the entire support shank is movable in a longitudinal direction relative to the sole).

In similar fashion, toe strap 108 and heel strap 110 may be secured to sole 102 using any suitable method or device. In this example, toe strap 108 is secured to sole 102 by clamping (and/or adhering, bonding, etc.) the ends of the strap between clamp plates 180, 182 and corresponding clamp plate receivers 184, 186, as shown in FIG. 17. Likewise, heel strap 110 is secured to sole 102 by clamping (and/or adhering, bonding, etc.) the ends of the strap between clamp plates 188, 190 and corresponding clamp plate receivers 192, 194.

A block 130 is affixed to rear end portion 124 of support shank 116, extending generally downward through an opening or aperture 132 in sole 102. As depicted in the drawings, block 130 is substantially cuboidal. However, block 130 may have any suitable shape and/or size. Aperture 132 is larger than the block, at least in a longitudinal dimension, such that block 130 can move longitudinally from a front side 134 of the aperture to a rear side 136 of the aperture. This longitudinal dimension may be selected to determine the limits of such movement, and thereby to determine the limits of movement of the support relative to the sole.

Block 130 may be secured to support shank 116 using any suitable structure or device. In this example, support 116 is held between a clamp plate 138 and block 130, and fastened using a pair of screws 140, e.g., as shown in FIG. 17. An access plate 142 is used to cover the opening in sole 102 above this portion of the support shank and prevent interference and discomfort with respect to the user's foot. In general, a function of block 130 is to interface with a corresponding feature of the heel portion to establish and/or secure the longitudinal position of the support shank relative to the sole. As best shown in FIG. 22, when shoe 100 is converted to a low-heel configuration, sole 102 extends rearward slightly with respect to support shank 116, which is secured at its front end. This leaves an empty space at the back end of cavity 118. Block 130 and the heel portion interact to secure this arrangement and prevent further movement. As described further in Section C, block 130 has similar functionality when support shank 116 is free at both ends, in that embodiment both repositioning and securing the support with respect to the sole.

A heel attachment mechanism 144 is included in shoe 100, comprising features of the heel portion as well as of the sole. Heel attachment mechanism 144 may include any suitable structure and/or device configured to releasably secure the heel portion to the sole. For example, one or more of the heel attachment mechanisms described in Section A may be used with shoe 100. In this example, heel attachment mechanism 144 includes a heel receiver 146 attached to sole 102. Heel receiver 146 may be affixed to sole 102 using any suitable method, and in this example is formed as a part of sole 102 (e.g., as a part of insole 112 extending downward through outsole 114. Specifically, heel receiver includes a fixed hook portion 148 which extends from a base 149 of the heel receiver, a movable hook portion 150 disposed opposite the fixed hook portion, and an actuator 152 configured to move the movable hook portion between a retracted position and an extended position.

Hook portions 148 and 150 may be oriented in any direction, e.g., with the fixed hook facing forward, left, right, or rearward, and the movable hook facing in the opposite direction. Here, fixed hook portion 148 faces toward the rear, and movable hook portion 150 faces toward the front of the shoe. Movable hook portion 150 is biased toward the extended, or forward, position. Any suitable biasing device may be used. Here, a coil spring 154 is used, as shown in FIGS. 16, 17, 21, and 22.

Actuator 152 is connected to movable hook portion 150, such that operation (e.g., manual operation) of actuator 152 against the biasing force of spring 154 causes the movable hook to retract. In the example shown in the drawings, actuator 152 is of a single piece with movable hook portion 150, and has a pair of channels 156 that permit longitudinal sliding of the actuator, as guided by the screws and/or guidepins of a retainer plate 158 that holds the actuator and movable hook against a bottom surface of the heel receiver base.

Heel portions 104 and 106 each include an upper mounting surface, namely upper mounting surface 160 and upper mounting surface 162, respectively, for attaching the heel portion to the heel receiver. Each of these upper mounting surfaces includes a first recess 164, 166 configured to engage fixed hook portion 148 and a second recess 168, 170, configured to engage movable hook portion 150, such that, when the heel portion is engaged with the heel receiver, the heel portion is secured to the heel receiver when the movable hook portion is in the extended position and the heel portion is releasable from the heel receiver when the movable hook portion is in the retracted position.

As shown in the drawings, aperture 132 extends through sole 102 between fixed hook portion 148 and movable hook portion 150. More specifically, aperture 132 passes in a generally vertical direction through the sole and through base 149, forming a walled channel or passageway.

Each of upper mounting surfaces 160 and 162 further includes an upward-protruding wedge, namely wedge 172 of high heel portion 104 and wedge 174 of low heel portion 106. Each of these wedges is configured to penetrate aperture 132 and interface with block 130, albeit in a different manner. Specifically, installing a heel portion onto the heel receiver causes wedge 172 or 174 to abut a forward or rear face of block 130, forcing block 130 in a selected longitudinal direction. When installed, the geometric relationship of wedges 172 and 174 relative to aperture 132 determines whether block 130 is wedged against front side 134 or rear side 136 of aperture 132. In other words, the fore-and-aft position of the upward-protruding wedge on the heel portion determines the direction in which it applies force to block 130, locking the block between the wedge and the wall of the aperture. In this example, wedge 172 of high heel portion 104 sits further forward on mounting surface 160 than wedge 174 of low heel portion 106 does on mounting surface 162. Accordingly, with shoe 100, installing high heel portion 104 will lock block 130 against rear side 136 of aperture 132. Similarly, installing low heel portion 106 will lock block 130 against front side 134 of aperture 132.

In operation, shoe 100 may be converted between two or more interchangeable heels as follows. Starting with sole portion 102 having no heel attached, upper mounting surface 160 of high heel portion 104 may be placed into engagement with heel receiver 146. Specifically, heel portion 104 may be placed at an angle such that fixed hook 148 inserts into rear hook-receiving recess 164 and engages therein. The heel portion may then be pivoted upward, such that movable hook 150 comes into contact with the upper mounting surface, forcing the movable hook to retract against spring 154 and allowing the heel portion to fully engage the heel receiver. Once fully engaged, spring 154 will force movable hook 150 to extend into front hook-receiving recess 148. This may be experienced by the user as the heel "snapping" into place. If necessary, actuator 152 may be utilized to aid in the process of retracting and/or extending movable hook 150. Furthermore, support shank 116 and block 130 may require manual positioning before or during full engagement of the heel portion with the heel receiver, to permit proper engagement of wedge 172 with block 130. In some examples, wedge 172 automatically positions block 130 and therefore support shank 116. FIG. 21 shows how the various components relate to each other when high heel portion 104 is installed on shoe 100.

Reversing the process to remove high heel portion 104, actuator 152 is manipulated rearward to retract movable hook 150, permitting disengagement of the front side of the heel portion. Heel portion 104 can then be pivoted and removed from fixed hook 148, thereby removing the heel portion altogether.

Similarly, low heel portion 106 can then be installed by placing upper mounting surface 162 of low heel portion 106 into engagement with heel receiver 146. Specifically, heel portion 106 may be placed at an angle such that fixed hook 148 inserts into rear hook-receiving recess 166 and engages therein. The heel portion may then be pivoted upward, such that movable hook 150 comes into contact with the upper mounting surface, forcing the movable hook to retract against spring 154 and allowing the heel portion to fully engage the heel receiver. Once fully engaged, spring 154 will force movable hook 150 to extend into front hook-receiving recess 170. Again, if necessary, actuator 152 may be utilized to aid in the process of retracting and/or extending movable hook 150. As above, support shank 116 and block 130 may require manual positioning before or during full engagement of the heel portion with the heel receiver, to permit proper engagement of wedge 174 with block 130. In some examples, wedge 174 automatically positions block 130 and therefore support shank 116. FIG. 22 shows how various components relate to each other when low heel portion 106 is installed on shoe 100.

Although a high heel and a low heel are described in the various embodiments herein, any combination of heights, whether different or the same, may be used. For example, shoe 100 may be convertible between similar as well as different heel heights. For example, two high heels, one slightly higher than the other, may be included with sole 102, and both may include an upward-protruding wedge substantially similar to wedge 172.

C. Third Illustrative Convertible Shoe

Figure 23:
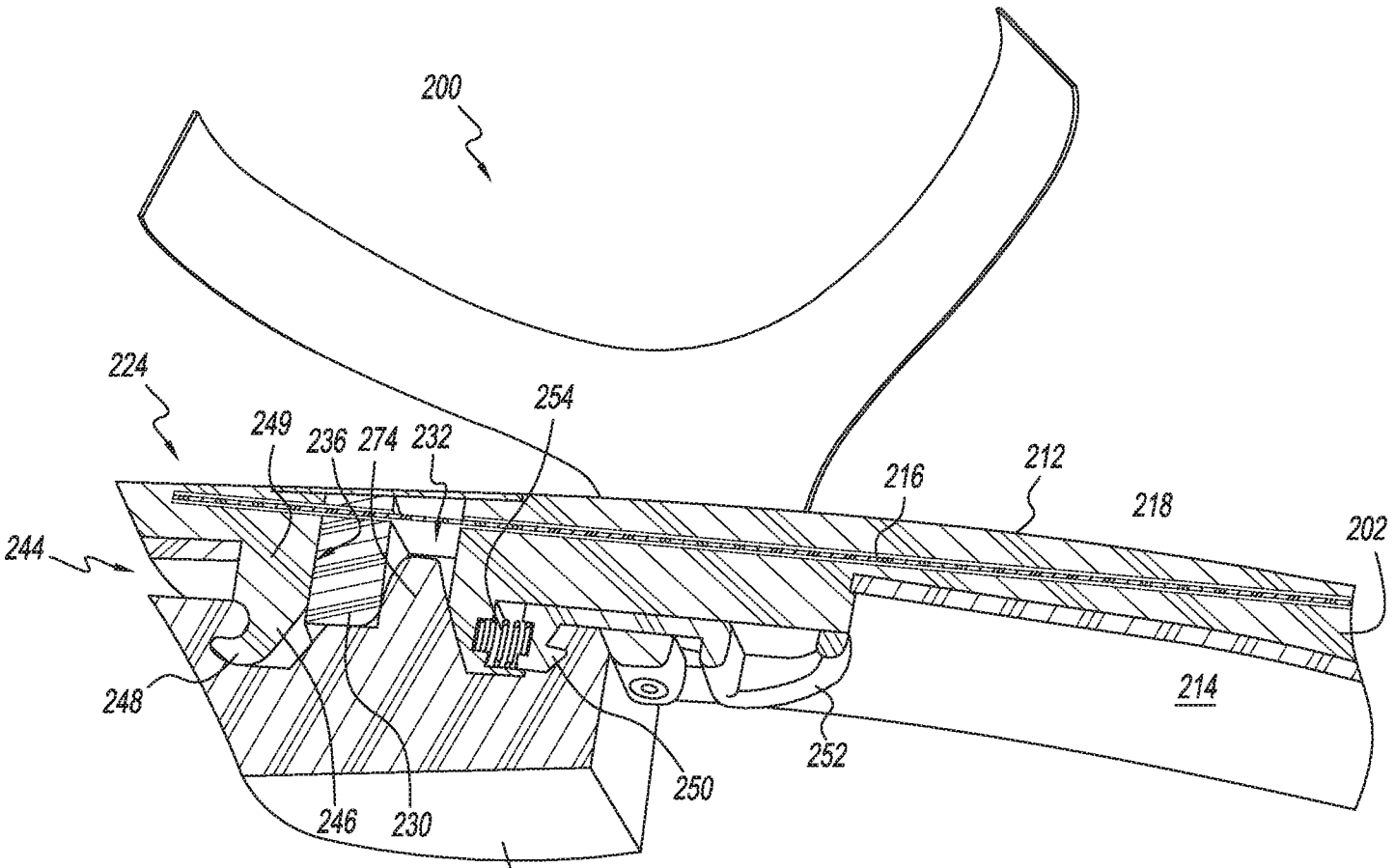
FIG. 23 is a partial sectional view of another illustrative convertible shoe in a low heeled mode.
Figure 24:
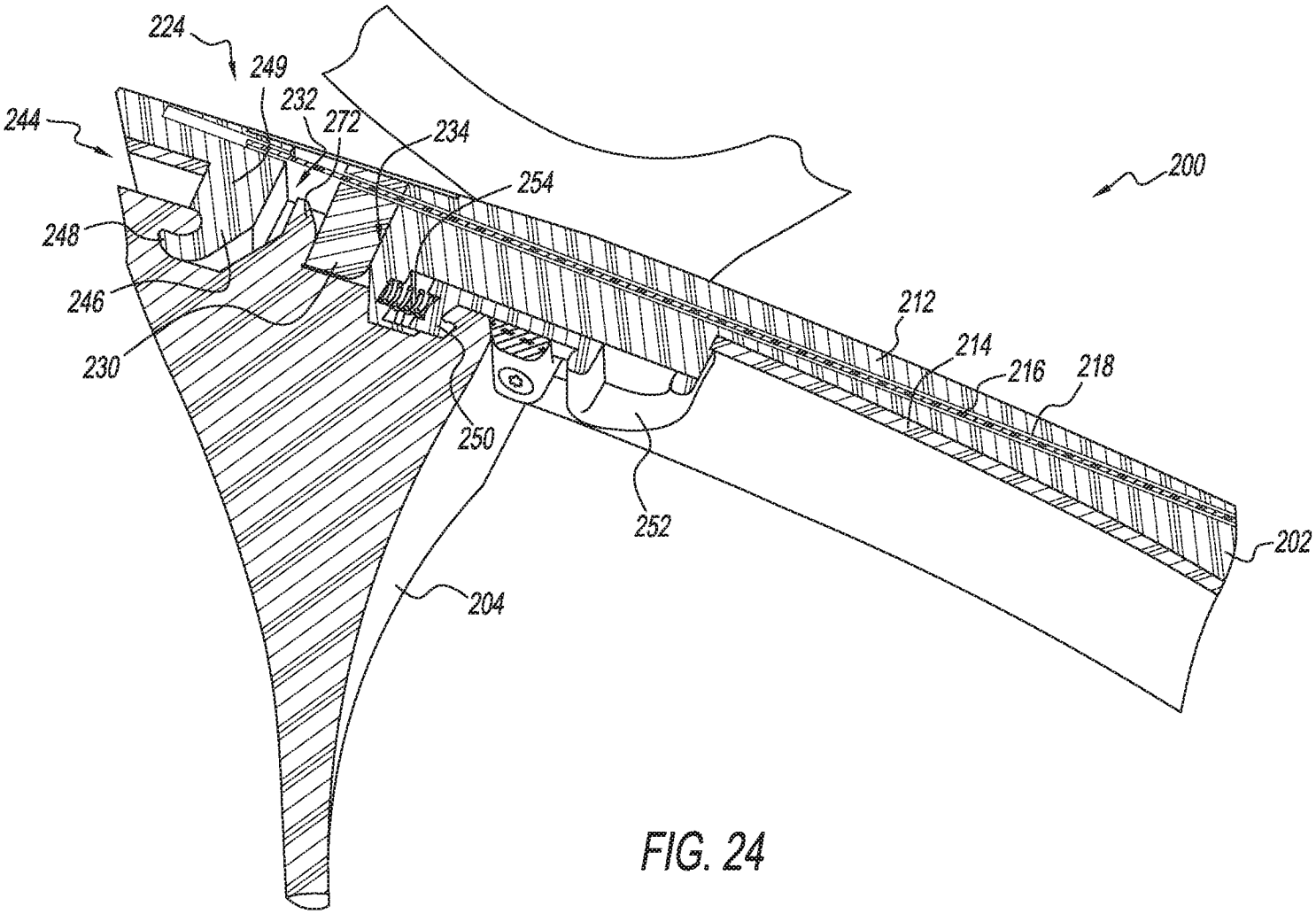
FIG. 24 is a partial sectional view of the shoe of FIG. 23 in a high heeled mode.

As shown in FIGS. 13, 23, and 24, this section describes an illustrative convertible shoe 200. Shoe 200 is another example of the convertible shoe described in the Overview above, having selected characteristics of shoe 1 and of shoe 100, as further described below. FIG. 13 is an overhead view of shoe 100 (see Section B), showing where an illustrative support shank may be positioned on shoe 200, which is substantially identical to shoe 100 in this view otherwise. FIG. 23 is a partial sectional view showing a low heel installed on shoe 200, and FIG. 24 is a partial sectional view showing a high heel installed on shoe 200.

In general, shoe 200 is substantially identical to shoe 100, other than with respect to the support shank and the upward protruding wedges of the heel portions. Regarding operation of the support shank, shoe 200 may be regarded as more similar to shoe 1, in that the entirety of the support shank is longitudinally movable with respect to the sole, with its attendant advantages.

Specifically, shoe 200 includes a sole 202 and a number of interchangeable heel portions that are releasably securable to the sole (e.g., a high heel portion 204 and a low heel portion 206). As with shoe 100, shoe 200 may include an upper or any other suitable portion configured to hold a foot of the user.

Sole 202 may be unitary, but in this example includes an insole portion 212 generally layered atop an outsole portion 214. More or fewer layers may be included.

A support shank 216 is housed at least partially within a pocket or cavity 218 formed in sole 202. As with shoe 100, support shank 216 and sole 202 are at least partially movable relative to each other. In this example, the entirety of the support shank is free to slide longitudinally with respect to the sole, within limits. With reference to FIG. 13, an example of support shank 216 is depicted in a forward position C and a rearward position D.

In this example, cavity 218 is formed entirely in insole portion 212. However, other suitable configurations may be utilized. For example, cavity 218 may be formed between insole 212 and outsole 214, or partially in each. In the example of shoe 200, the entire support shank is movable in a longitudinal direction within cavity 218, relative to the sole.

A block 230 is affixed to a rear end portion 224 of support shank 216, extending generally downward through an opening or aperture 232 in sole 202. Block 230 and aperture 232 are substantially identical to corresponding block 130 and aperture 132 of shoe 100. As described above, block 230 can move longitudinally from a front side 234 of the aperture to a rear side 236 of the aperture. A longitudinal dimension between front side 234 and rear side 236 may be selected to determine the limits of such movement, and thereby to determine the limits of movement of the support relative to the sole.

As shown in FIG. 23, when shoe 200 is converted to a low-heel configuration, support shank 216 is shifted rearward within cavity 218, into position D. Block 230 and the heel portion interact to secure this arrangement and prevent further movement. As described further below, this interaction both repositions and secures the support with respect to the sole.

A heel attachment mechanism 244 is included in shoe 200, and is substantially identical to heel attachment mechanism 144, described above. As mentioned in Section B, one or more of the heel attachment mechanisms described in Section A may be used with shoe 200. However, in this example, heel attachment mechanism 244 includes a heel receiver 246 attached to sole 202. As described with respect to heel receiver 146, heel receiver 246 includes a fixed hook portion 248 which extends from a base 249 of the heel receiver, a movable hook portion 250 disposed opposite the fixed hook portion, and an actuator 252 configured to move the movable hook portion between a retracted position and an extended position. All of the components of heel receiver 246 are substantially identical to those of heel receiver 146, and movable hook portion 250 is again biased toward the extended, or forward, position by a coil spring 254.

Heel portions 204 and 206 each include an upper mounting surface for attaching the heel portion to the heel receiver. Each of these upper mounting surfaces is substantially similar to the upper mounting surfaces of heel portions 104 and 106, with the exception of the placement of the upward-protruding wedges. Accordingly, each heel portion includes a first (front) recess and a second (rear) recess for engaging the fixed and movable hooks of heel receiver 246. However, a wedge 272 of high heel portion 204 and a wedge 274 of low heel portion 206 are positioned differently than their corresponding components in shoe 100. Each of these wedges is again configured to penetrate aperture 232 and interface with block 230. Installing a heel portion onto the heel receiver again causes wedge 272 or 274 to abut a forward or rear face of block 230, forcing block 230 in a selected longitudinal direction. In this example, wedge 272 of high heel portion 204 sits further rearward on the mounting surface than wedge 274 of low heel portion 206 does on its mounting surface. Accordingly, with shoe 200, installing high heel portion 204 will position and lock block 230 against rear side 236 of aperture 232. Similarly, installing low heel portion 206 will position and lock block 230 against front side 234 of aperture 232.

In operation, shoe 200 may be converted between two or more interchangeable heels as follows. Starting with sole portion 202 having no heel attached, the upper mounting surface of high heel portion 204 may be placed into engagement with heel receiver 246. Specifically, heel portion 204 may be placed at an angle such that fixed hook 248 inserts into the rear hook-receiving recess and engages therein. The heel portion may then be pivoted upward, such that movable hook 250 comes into contact with the upper mounting surface, forcing the movable hook to retract against spring 254 and allowing the heel portion to fully engage the heel receiver. Once fully engaged, spring 254 will force movable hook 250 to extend into the front hook-receiving recess. This may again be experienced by the user as the heel "snapping" into place. If necessary, actuator 252 may be utilized to aid in the process of retracting and/or extending movable hook 250. Furthermore, support shank 216 and block 230 may require manual positioning before or during full engagement of the heel portion with the heel receiver, to permit proper engagement of wedge 272 with block 230. In other words, the user may manually force block 230 forward in aperture 232 before installing the heel. In some examples, wedge 272 automatically positions block 230 and therefore support shank 216. FIG. 24 shows how various components relate to each other when high heel portion 204 is installed on shoe 200.

Reversing the process to remove high heel portion 204, actuator 252 is manipulated rearward to retract movable hook 250, permitting disengagement of the front side of the heel portion. Heel portion 204 can then be pivoted and removed from fixed hook 248, thereby removing the heel portion altogether.

Similarly, low heel portion 206 can then be installed by placing the upper mounting surface of low heel portion 206 into engagement with heel receiver 246. Specifically, heel portion 206 may be placed at an angle such that fixed hook 248 inserts into the rear hook-receiving recess and engages therein. The heel portion may then be pivoted upward, such that movable hook 250 comes into contact with the upper mounting surface, forcing the movable hook to retract against spring 254 and allowing the heel portion to fully engage the heel receiver. Once fully engaged, spring 254 will force movable hook 250 to extend into the front hook-receiving recess. As above, support shank 216 and block 230 may require manual positioning before or during full engagement of the heel portion with the heel receiver, to permit proper engagement of wedge 274 with block 230. In other words, the user may manually force block 230 rearward in aperture 232 before installing the heel. In some examples, wedge 274 automatically positions block 230 and therefore support shank 216 (i.e., into rearward position D). FIG. 23 shows how various components relate to each other when low heel portion 206 is installed on shoe 200.

D. Fourth Illustrative Convertible Shoe

As shown in FIGS. 25-35, this section describes an illustrative convertible shoe 300. Shoe 300 is another example of the convertible shoe described in the Overview above. Features of shoe 300 may be combined with features of shoes 1, 100, and/or 200, as desired.

Figure 25:
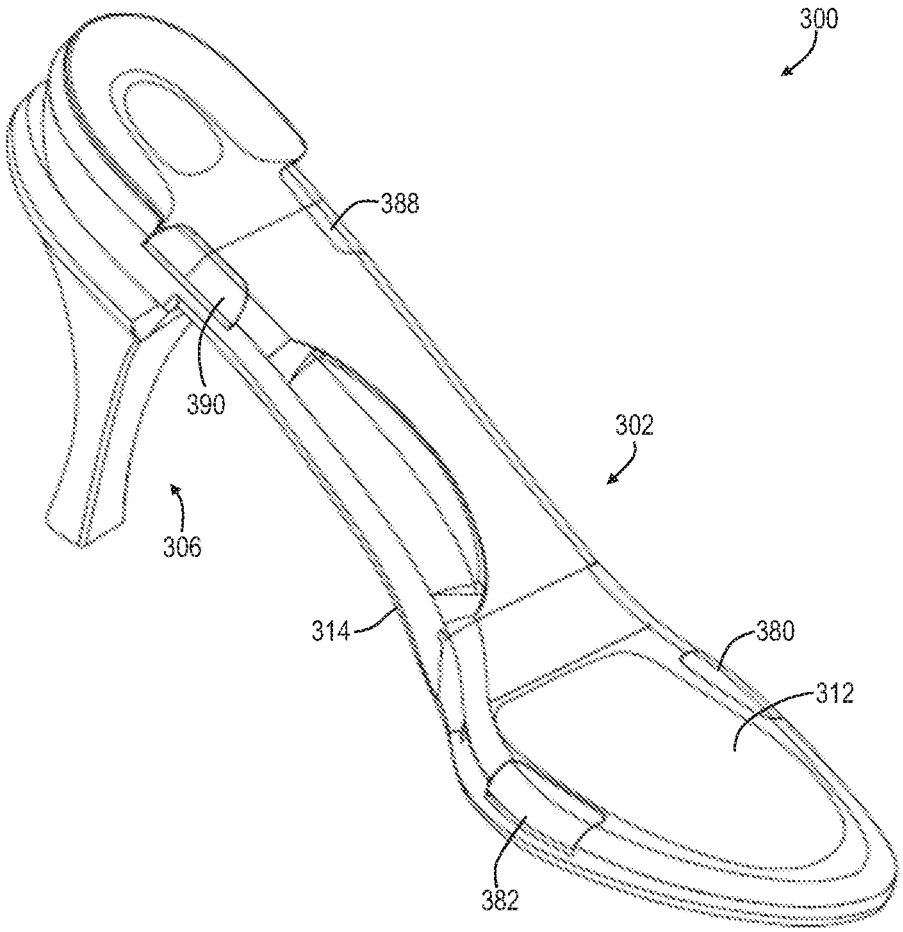
FIG. 25 is an isometric view of another illustrative convertible shoe in a high heeled mode.
Figure 26:
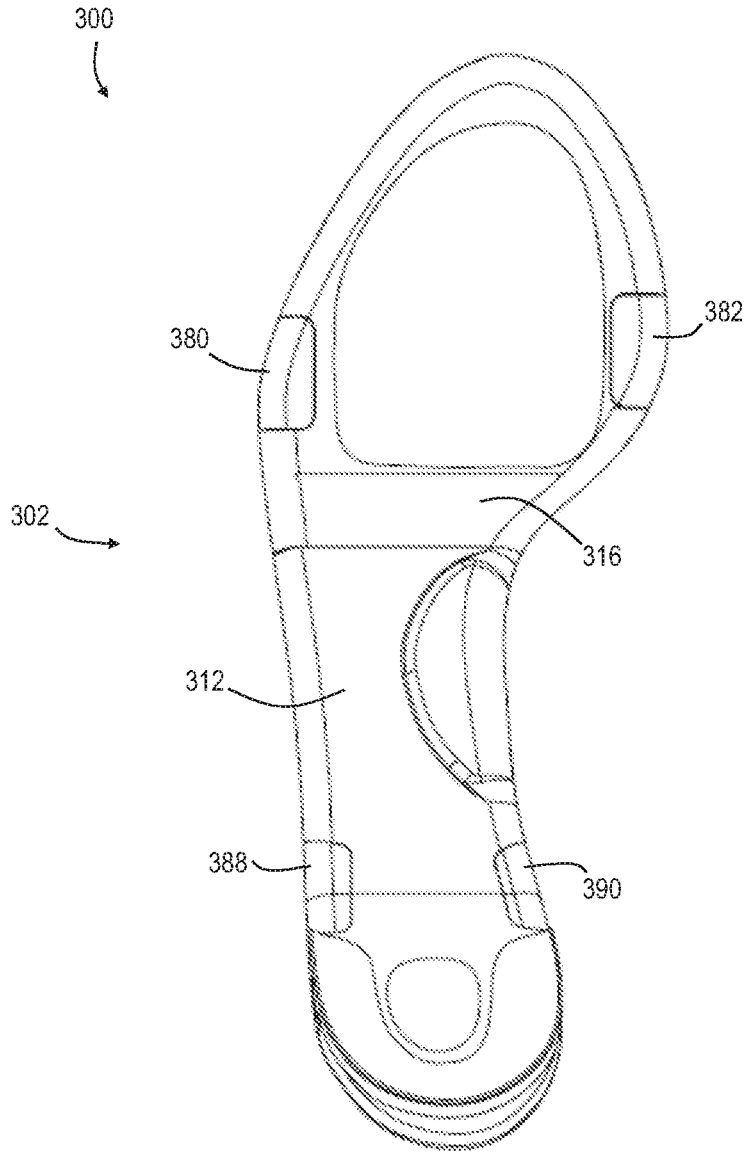
FIG. 26 is a top plan view of the shoe of FIG. 25.
Figure 27:
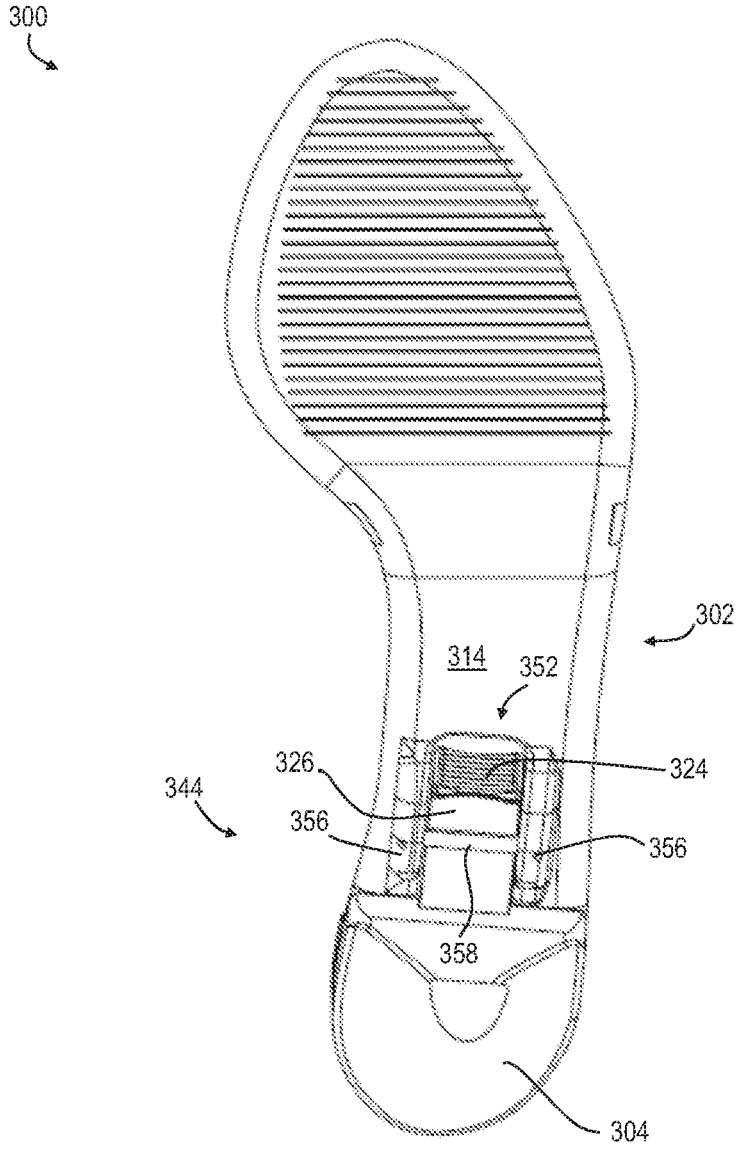
FIG. 27 is a bottom plan view of the shoe of FIG. 25.
Figure 28:
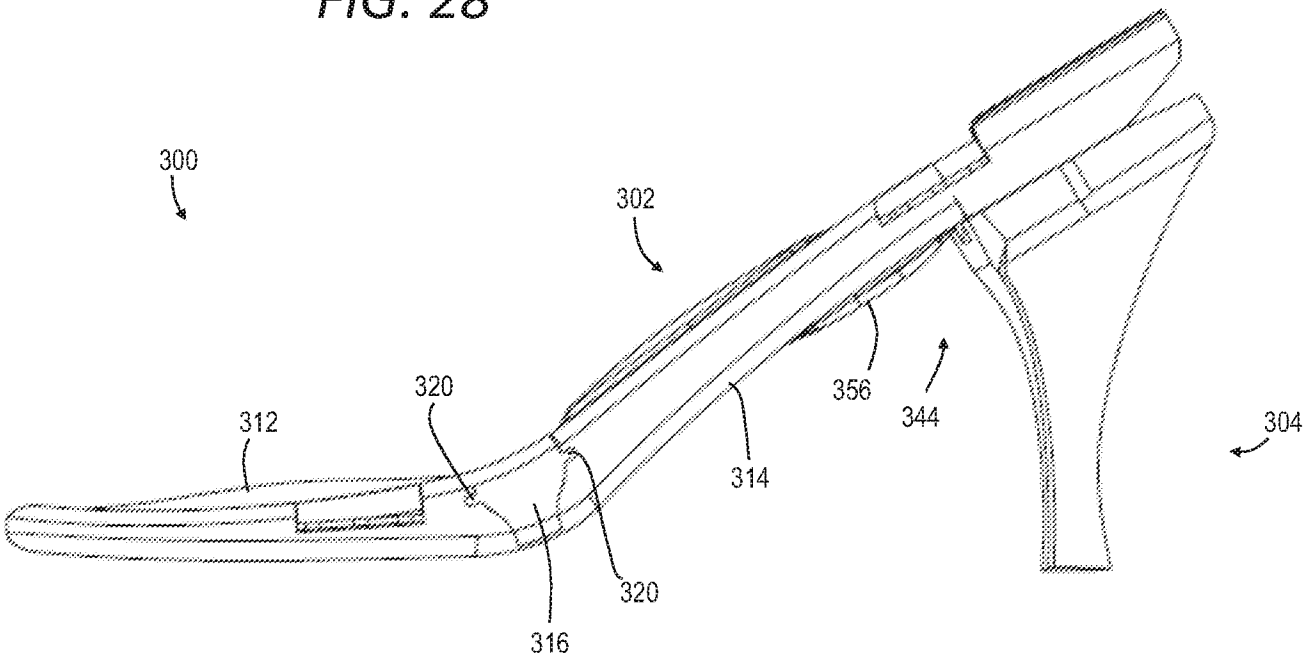
FIG. 28 is a left side elevation view of the shoe of FIG. 25.
Figure 29:
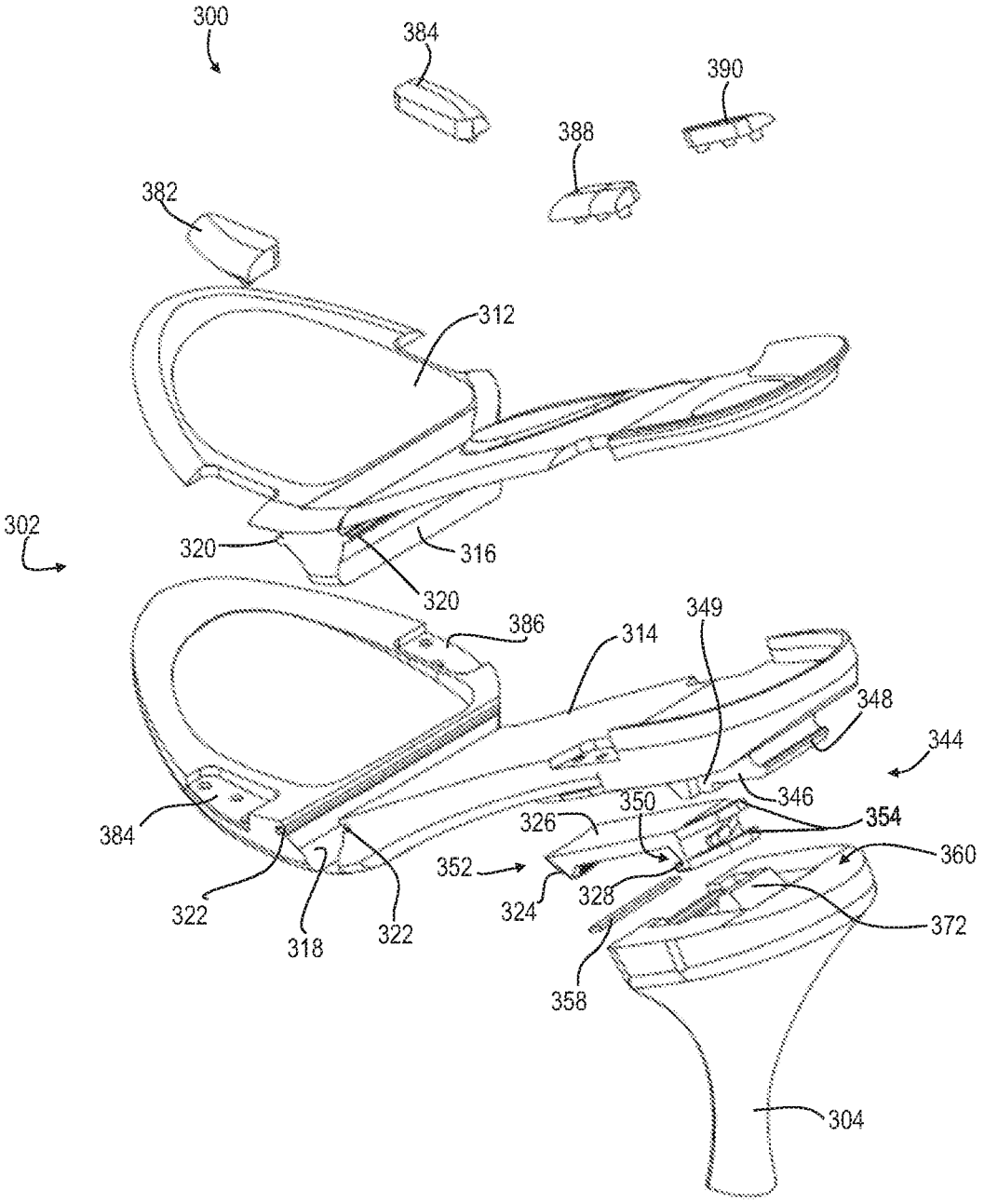
FIG. 29 is an exploded view of the shoe of FIG. 25.
Figure 30:
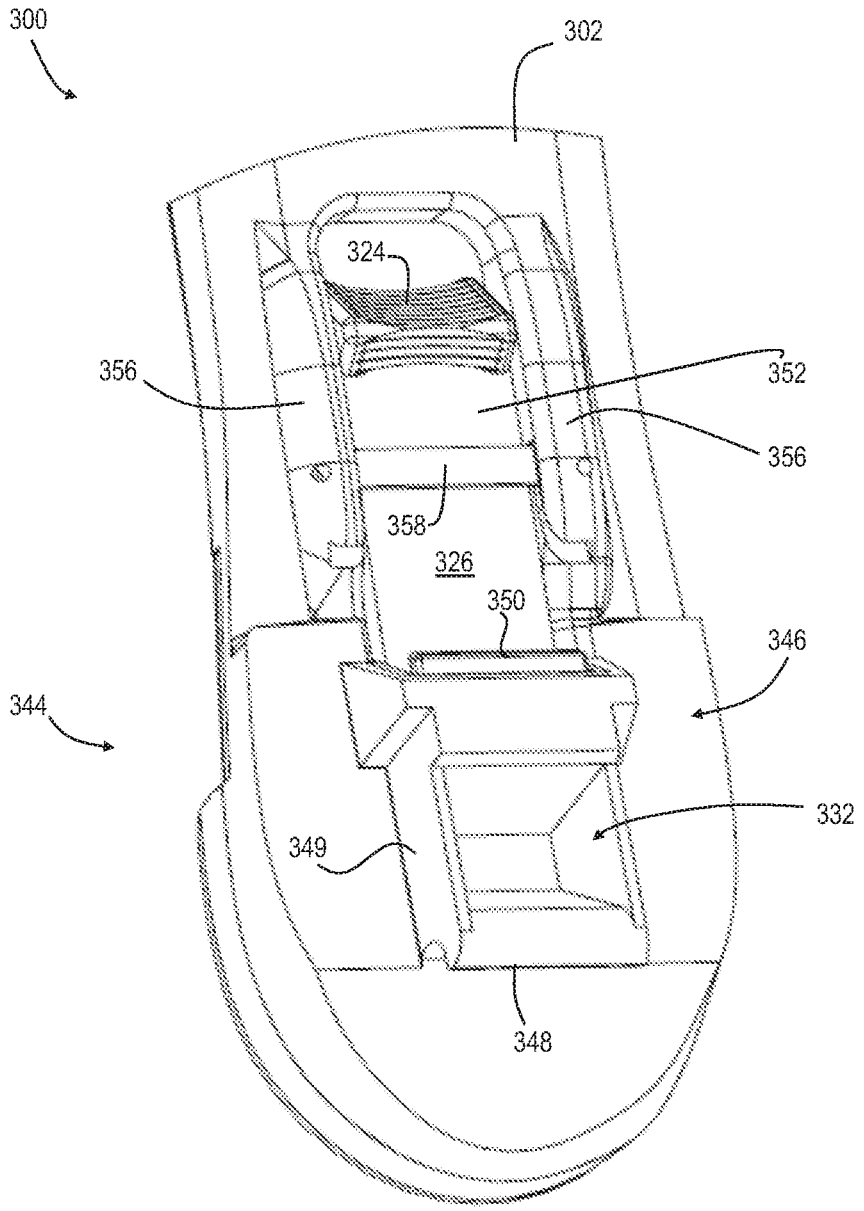
FIG. 30 is a magnified isometric view of a heel receiver portion of the shoe of FIG. 25.
Figure 31:
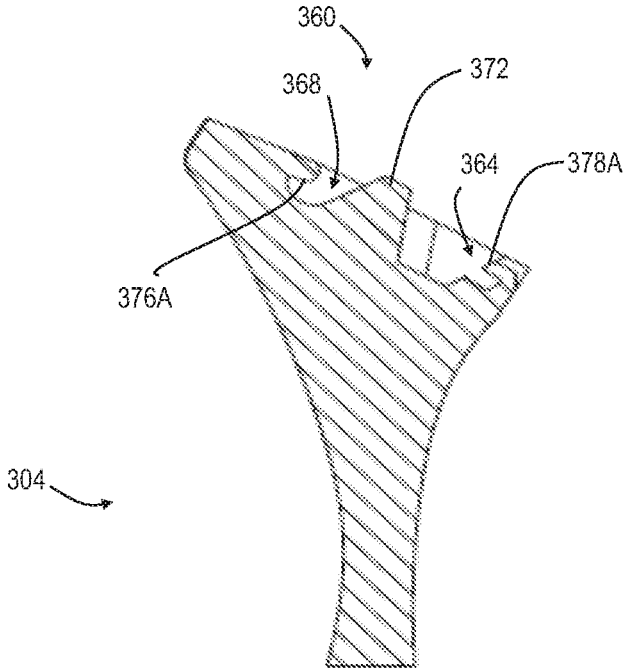
FIG. 31 is a sectional view of an illustrative high heel portion suitable for use with the shoe of FIG. 25.
Figure 32:
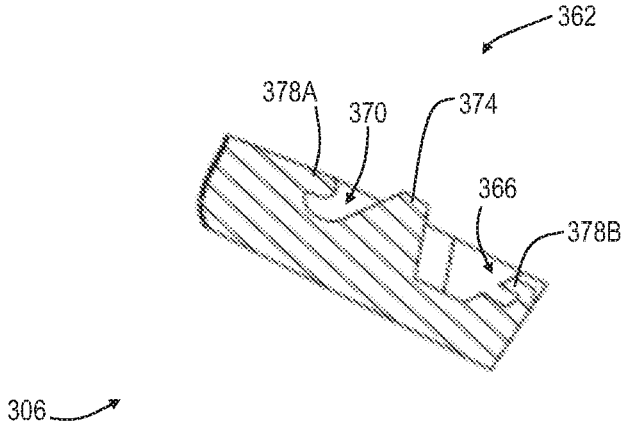
FIG. 32 is a sectional view of an illustrative low heel portion suitable for use with the shoe of FIG. 25.
Figure 33:
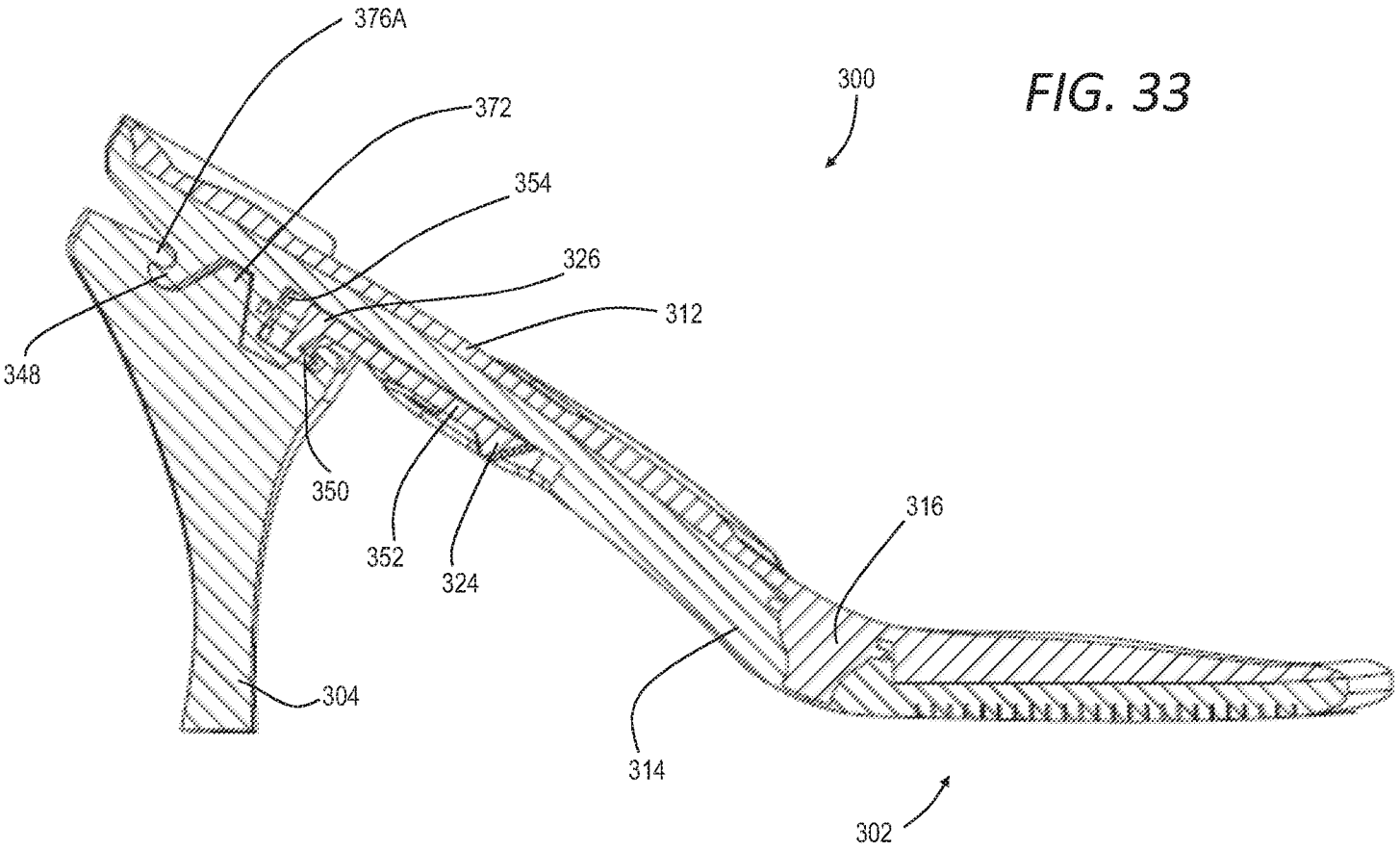
FIG. 33 is a sectional view of the shoe of FIG. 25, in the high heeled mode.
Figure 34:
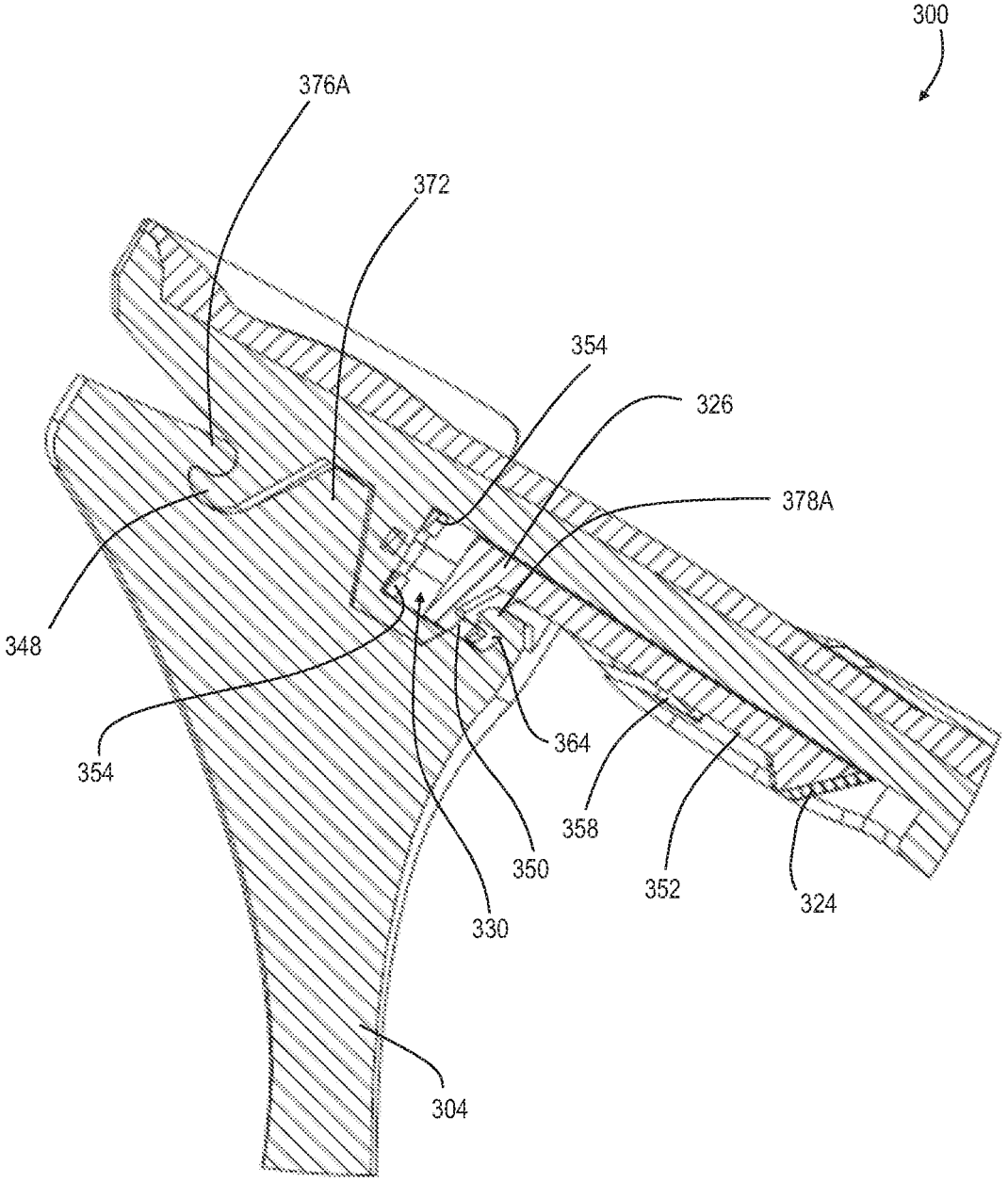
FIG. 34 is a partial sectional view of the shoe of FIG. 25, in the high heeled mode.
Figure 35:
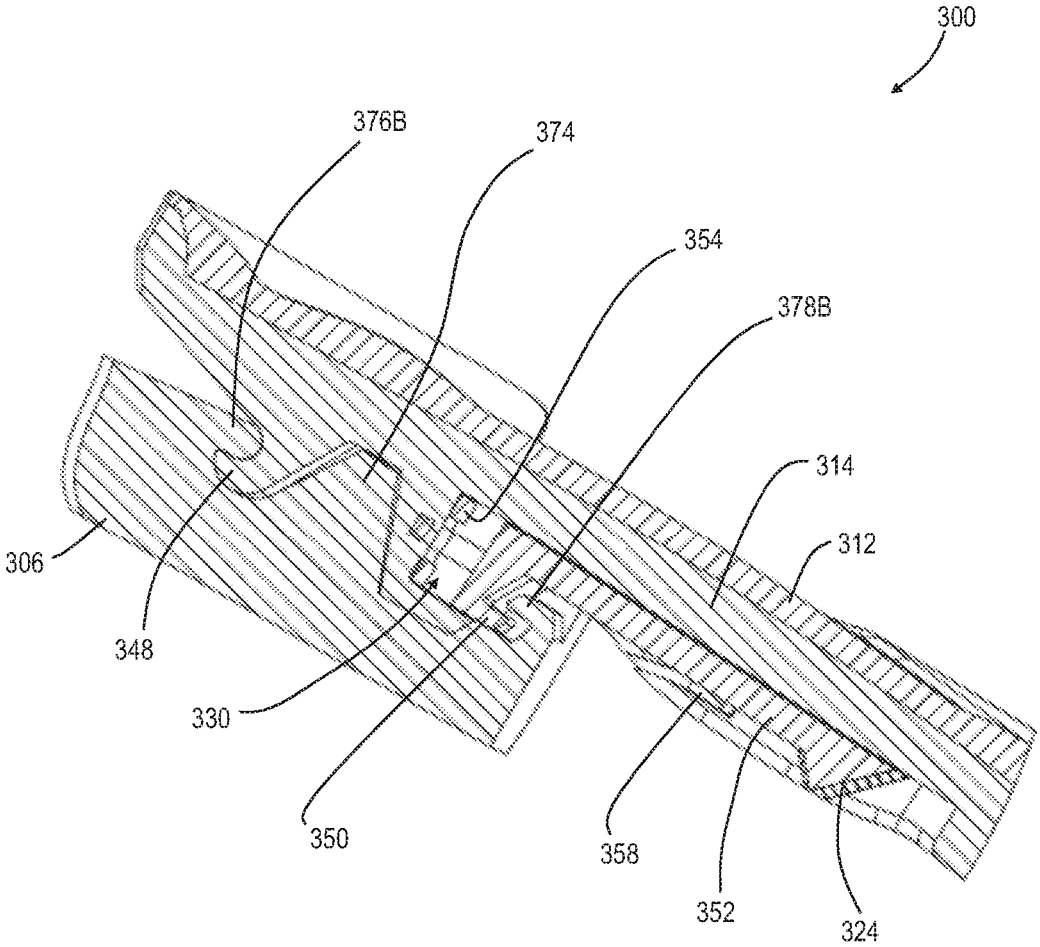
FIG. 35 is a partial sectional view of the shoe of FIG. 25, in a low heeled mode.

Shoe 300 is depicted in an orthogonal view in FIG. 25, a top plan view in FIG. 26, a bottom plan view in FIG. 27, and a side view in FIG. 28. FIG. 29 depicts an exploded view of various components of shoe 300. FIG. 30 is a magnified view of a heel receiver portion of the shoe, and FIGS. 31 and 32 are sectional views of two different heel portions suitable for use with shoe 300. FIGS. 33 and 34 are sectional views of the assembled shoe, showing how the heel portion of FIG. 31 attaches to the heel receiver, and FIG. 35 is a partial sectional view showing a similar connection between the heel portion of FIG. 32 and the heel receiver. Although this example refers to a shoe, the features of the present disclosure can be used with any suitable article of footwear, e.g., boots, shoes, sandals, etc.

Shoe 300 includes a sole 302 and a number of interchangeable heel portions that are releasably securable to the sole. In the present example, shoe 300 includes a high heel portion 304 and a low heel portion 306, also referred to as a tall heel portion and a short heel portion, respectively. Shoe 300 may also include an upper, as described above with respect to shoe 1, or any other suitable portion configured to hold a foot of the user. For example, shoe 300 may include a toe strap and/or a heel strap as described with respect to shoe 100.

Sole 302 includes an insole portion 312 generally layered atop an outsole portion 314. As described above, the insole and outsole may comprise any suitable materials, and may be affixed together using known methods. In some examples, however, sole 302, including both insole portion 312 and outsole portion 314, may be generated in a single process, such as via multi-material 3-D printing, in which the sole is built in an additive manufacturing process (e.g., all layers of the sole). In general, outsole portion 314 may include a tougher, less resilient material than insole portion 312, e.g., for wear-resistance. Insole portion 312 may include a softer, more resilient material, e.g., for comfort. In some examples, sole 302 may include more or fewer layers.

Straps or other components may be secured to sole 302 by one or more clamp plates. For example, as best shown in FIGS. 25, 26, and 29, clamp plates 380, 382 and corresponding recessed clamp plate receivers 384, 386, may be utilized on a front (i.e., toe) end of the sole. Likewise, clamp plates 388, 390 may be secured in corresponding receivers on a heel end of the sole. Clamp plates and receivers may further add to the stability of the layered sole by preventing lateral movement of the layers relative to each other.

In this example, insole portion 312 includes a cushioning wedge 316 disposed in a region of the insole where a user's metatarsophalangeal (MTP) joints (i.e., the heads of the metatarsal bones) would typically exert pressure, e.g., just rearward of the toes, at the ball of the foot. Wedge 316 may comprise the softer, more resilient material of insole 312, and may be unitary with the insole portion. As depicted in this example, wedge 316 is received by a corresponding wedge receiver 318 in outsole portion 314. Wedge 316 and wedge receiver 318 are keyed together for additional security. As described above, the insole and outsole portions may be manufactured additively, e.g., in a single operation. In any event, the keying feature here includes a pair of ridges 320 on wedge 316 and corresponding pair of channels 322 in wedge receiver 318, configured to mate together and lock the wedge into the wedge receiver. Other suitable keying features may be utilized, including those amenable to 3-D printing.

A heel attachment mechanism 344 is included in shoe 300, comprising features of the heel portion as well as of the sole. Heel attachment mechanism 344 may include any suitable structure and/or device configured to releasably secure the heel portion to the sole. For example, one or more of the heel attachment mechanisms described in Section A, B, or C may be used with shoe 300. In this example, heel attachment mechanism 344 includes a heel receiver 346 attached to sole 302. Heel receiver 346 may be affixed to sole 302 using any suitable method (e.g., by an adhesive), and in this example is formed as a part of sole 302 (e.g., as a downward-extending part of outsole portion 314).

Specifically, heel receiver 346 includes a fixed hook portion 348 which extends from a base 349 of the heel receiver, a movable hook portion 350 disposed opposite the fixed hook portion, and an actuator 352 configured to move the movable hook portion between a retracted position and an extended position. As shown in the drawings, a recess 332 for receiving a wedge of the heel portion (described below) extends into heel receiver 346 between fixed hook portion 348 and movable hook portion 350.

Hook portions 348 and 350 may be oriented in any direction, e.g., with the fixed hook facing forward, left, right, or rearward, and the movable hook facing in the opposite direction. Here, as in shoe 100, fixed hook portion 348 faces toward the rear, and movable hook portion 350 faces toward the front of the shoe. Movable hook portion 350 is biased toward the extended, or forward, position. Any suitable biasing device may be used (see below).

Actuator 352 is operatively connected to movable hook portion 350, such that operation (e.g., manual operation) of actuator 352 against the force of the biasing device causes the movable hook to retract. In this embodiment, actuator 352 is of a single piece with movable hook portion 350. Specifically, the combined movable hook portion 350 and actuator 352 includes a generally triangular manual handle 324, textured for enhanced grippability, as well as an elongate body 326 on which is formed a hook 328 and an integral spring member 354. Manual handle 324 is exposed on the underside of the shoe, and accessible by the user.

Body 326 has a generally planar top, configured to slide while in contact with an underside of the outsole. A rear portion of the body is received into a cavity 330 formed in heel receiver 346, such that spring member 354 is disposed in cavity 330, and is in contact with a wall of the cavity. In this example, spring member 354 includes a plurality of resilient fingers or protrusions extending generally sideways or laterally across the rear of body 326, such that distal ends of the resilient fingers are spaced from the rear of the body. In some examples, the fingers may extend vertically or diagonally, rather than horizontally/laterally. In general, any suitable number and orientation of finger extensions may be utilized, such that the resilient fingers are configured to apply a biasing force by bending or pivoting toward the body when under load and resiliently returning (automatically) when the load is released. As mentioned above, these finger extensions may be integral with the body of movable hook portion 350, e.g., being simultaneously 3-D printed as a unitary part of the movable hook portion. Actuator 352 and movable hook 350 are guided and retained against outsole portion 314 by a pair of side guides 356 and a retainer bar 358, although any suitable retainer/guide mechanism may be utilized (see section B).

Heel portions 304 and 306 each include an upper mounting surface, namely upper mounting surface 360 and upper mounting surface 362, respectively, for attaching the heel portion to the heel receiver. Each of these upper mounting surfaces includes a first recess 364, 366 configured to engage fixed hook portion 348 and a second recess 368, 370, configured to engage movable hook portion 350, such that, when the heel portion is engaged with the heel receiver, the heel portion is secured to the heel receiver when the movable hook portion is in the extended position and the heel portion is releasable from the heel receiver when the movable hook portion is in the retracted position. Recesses 364 and 366 form corresponding lips 376A, 378A of heel portion 304, and lips 376B, 378B, of heel portion 306 (see FIGS. 31 and 32).

Each of upper mounting surfaces 360 and 362 further includes an upward-protruding wedge, namely wedge 372 of high heel portion 304 and wedge 374 of low heel portion 306. Each of these wedges is configured to be received snugly in recess 332 of the heel receiver. Specifically, installing a heel portion onto the heel receiver causes wedge 372 or 374 to mate with recess 332, adding further security and stability to the heel-shoe connection.

In operation, shoe 300 may be converted between two or more interchangeable heels as follows. Starting with sole portion 302 having no heel attached, upper mounting surface 360 of high heel portion 304 may be placed into engagement with heel receiver 346. Specifically, heel portion 304 may be placed at an angle such that fixed hook 348 inserts into rear hook-receiving recess 364 (i.e., under lip 376A) and engages therein. The heel portion may then be pivoted upward, such that movable hook 350 comes into contact with the upper mounting surface (e.g., with lip 378A), forcing the movable hook to retract against spring member 354 and allowing the heel portion to fully engage the heel receiver.

Once fully engaged, spring member 354 forces movable hook 350 to extend into front hook-receiving recess 348 (i.e., under lip 376A). This may be experienced by the user as the heel "snapping" into place. If necessary, actuator 352 may be manually shifted to aid in the process of retracting and/or extending movable hook 350. FIGS. 33-34 show how the various components relate to each other when high heel portion 304 is installed on shoe 300.

Reversing the process to remove high heel portion 304, actuator 352 is manipulated rearward to retract movable hook 350 against the biasing force of spring member 354, permitting disengagement of lip 376 and the front side of the heel portion. Heel portion 304 can then be pivoted and removed from fixed hook 348, thereby removing the heel portion altogether.

Similarly, low heel portion 306 can then be installed by placing upper mounting surface 362 of low heel portion 306 into engagement with heel receiver 346. Specifically, heel portion 306 may be placed at an angle such that fixed hook 348 inserts into rear hook-receiving recess 366 (i.e., under lip 376B) and engages therein. The heel portion may then be pivoted upward, such that movable hook 350 comes into contact with the upper mounting surface (e.g., with lip 378B), forcing the movable hook to retract against spring member 354 and allowing the heel portion to fully engage the heel receiver. Once fully engaged, spring 354 forces movable hook 350 to extend into front hook-receiving recess 370 (i.e., under lip 376B). Again, if necessary, actuator 352 may be utilized to aid in the process of retracting and/or extending movable hook 350.

FIG. 35 shows how various components relate to each other when low heel portion 306 is installed on shoe 300.

Although a high heel and a low heel are described in the various embodiments herein, any combination of heights, whether different or the same, may be used. For example, shoe 300 may be convertible between similar as well as different heel heights. For example, two high heels, one slightly higher than the other, may be included with sole 302.

E. Fifth Illustrative Convertible Shoe

Figure 36:
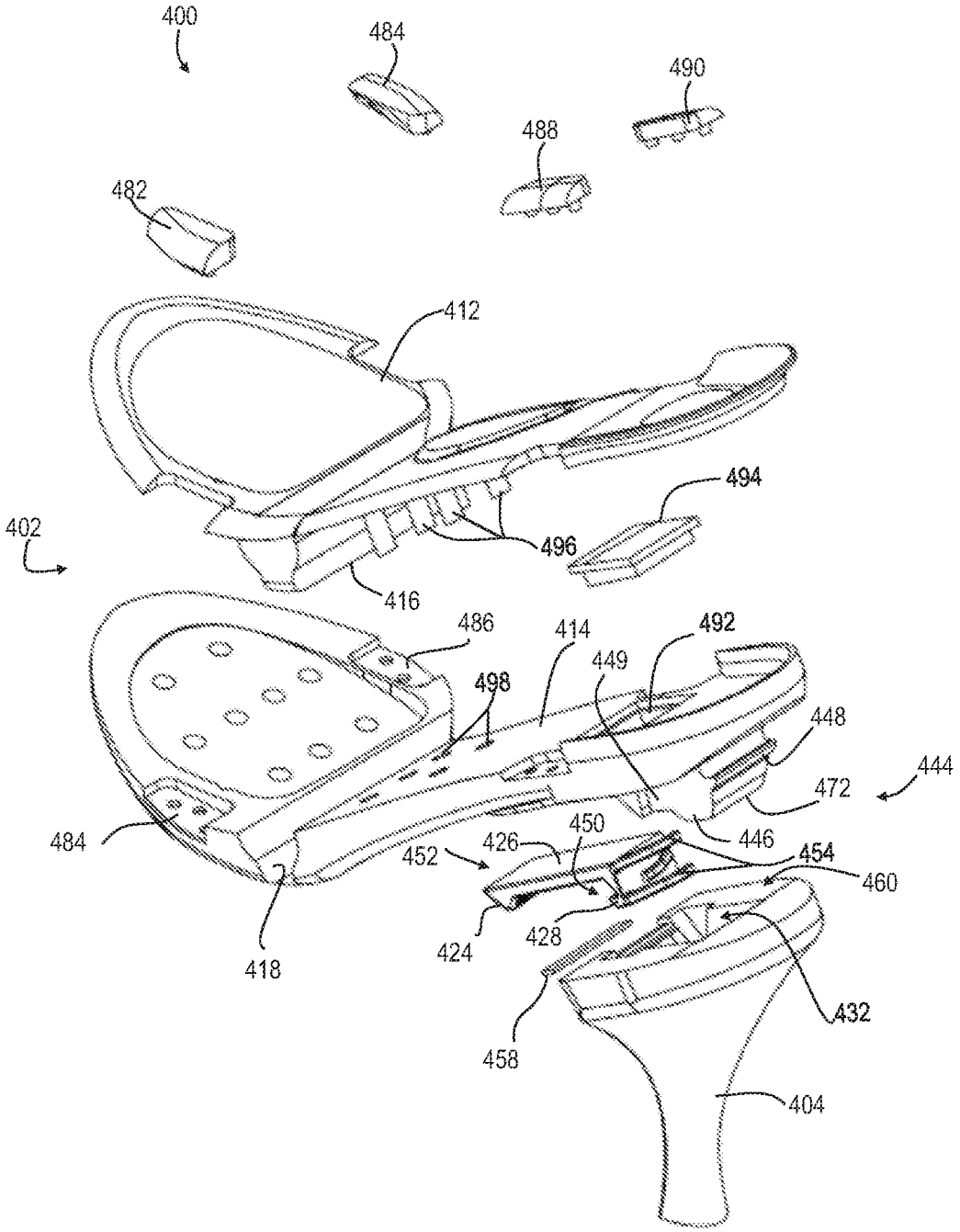
FIG. 36 is an exploded view of another illustrative convertible shoe.
Figure 37:
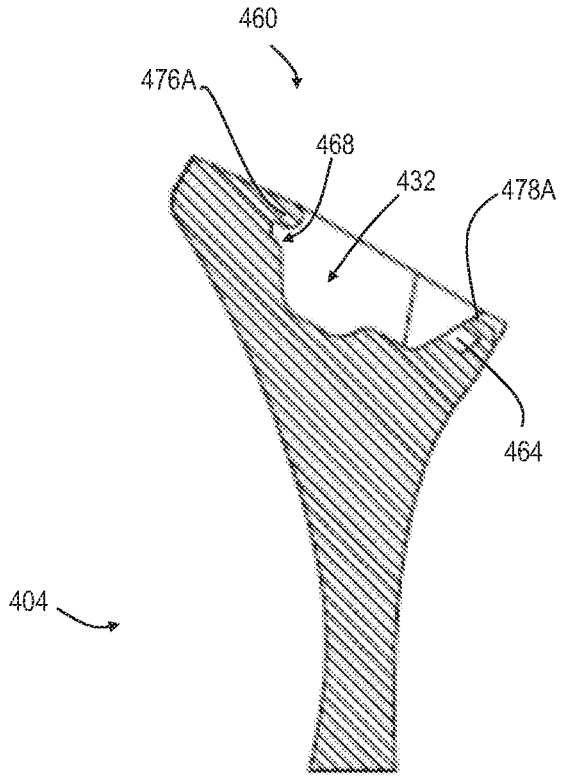
FIG. 37 is a sectional view of an illustrative high heel portion suitable for use with the shoe of FIG. 36.
Figure 38:
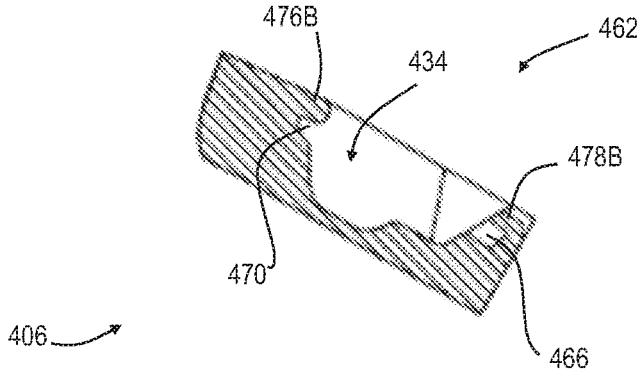
FIG. 38 is a sectional view of an illustrative low heel portion suitable for use with the shoe of FIG. 36.
Figure 39:
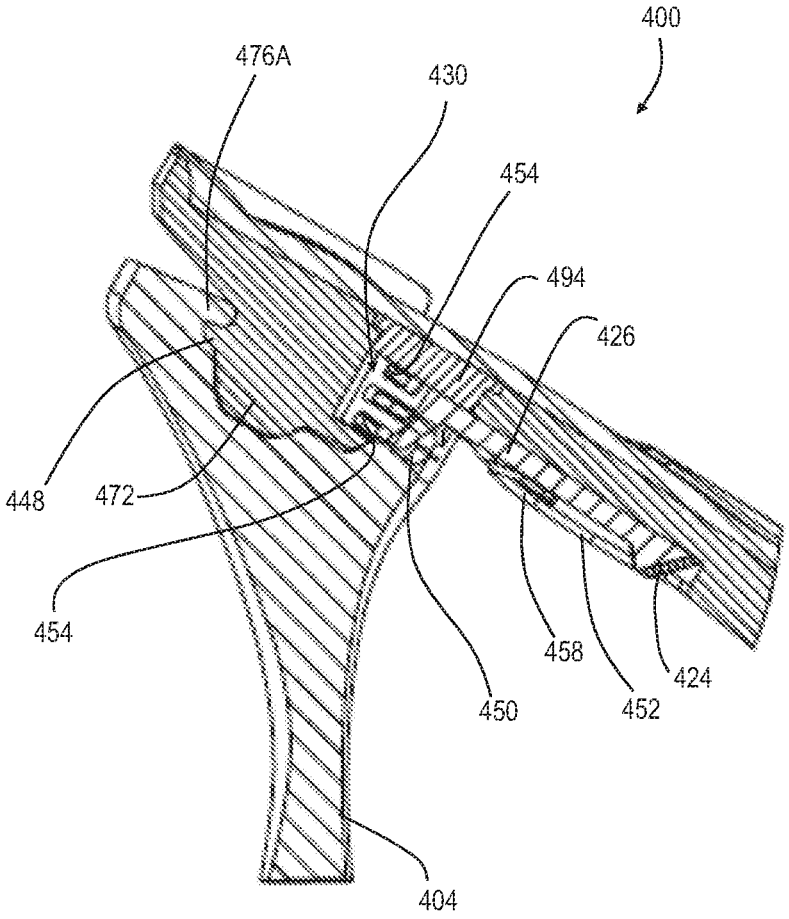
FIG. 39 is a partial sectional view of the shoe of FIG. 36, in a high heeled mode.

As shown in FIGS. 36-39, this section describes an illustrative convertible shoe 400. Shoe 400 is another example of the convertible shoe described in the Overview above, and may be considered a variation of shoe 300, as further described below. FIG. 36 is an exploded view of shoe 400, analogous to FIG. 29. FIGS. 37 and 38 are sectional views of high and low heel portions, analogous to FIGS. 31 and 32. FIG. 39 is a partial sectional view showing a high heel installed on shoe 400.

In general, shoe 400 is substantially identical to shoe 300, other than with respect to the differences described below. Generally speaking, portions of the heel connection mechanism of shoe 400 are inverted as compared with shoe 300, and the sole is more conducive to injection molding.

As with shoe 300, shoe 400 includes a sole 402 and a number of interchangeable heel portions that are releasably securable to the sole. In the present example, shoe 400 includes a high heel portion 404 and a low heel portion 406, also referred to as a tall heel portion and a short heel portion, respectively. Shoe 400 may also include an upper, as described above with respect to shoe 1, or any other suitable portion configured to hold a foot of the user. For example, shoe 400 may include a toe strap and/or a heel strap as described with respect to shoe 100.

Sole 402 includes an insole portion 412 generally layered atop an outsole portion 414. As described above, the insole and outsole may comprise any suitable materials, and may be affixed together using known methods. In this example, fixing the layers of the sole together may be facilitated by a plurality of pins or protrusions 496 on insole portion 412 configured to mate with corresponding apertures 498 formed in outsole portion 414. In general, outsole portion 414 may include a tougher, less resilient material than insole portion 412, e.g., for wear-resistance. Insole portion 412 may include a softer, more resilient material, e.g., for comfort. In some examples, sole 402 may include more or fewer layers.

Straps or other components may be secured to sole 402 by one or more clamp plates. For example, as best shown in FIG. 36, clamp plates 480, 482 and corresponding recessed clamp plate receivers 484, 486, may be utilized on a front (i.e., toe) end of the sole. Likewise, clamp plates 488, 490 may be secured in corresponding receivers on a heel end of the sole. Clamp plates and receivers may further add to the stability of the layered sole by preventing lateral movement of the layers relative to each other.

In this example, insole portion again 412 includes an extension or enlargement in the form of a cushioning wedge 416 disposed in a region of the insole where a user's metatarsophalangeal (MTP) joints (i.e., the heads of the metatarsal bones) would typically exert pressure. Wedge 416 may comprise the softer, more resilient material of insole 412, and may be unitary with the insole portion. As depicted in this example, wedge 416 is received by a corresponding wedge receiver 418 in outsole portion 414. Wedge 416 and wedge receiver 418 may be keyed together for additional security. Accordingly, as with shoe 300, a thicker portion of the insole extends into a recess of the outsole in a region of the sole corresponding to metatarsophalangeal joints of a user.

A heel attachment mechanism 444 is included in shoe 400, comprising features of the heel portion as well as of the sole. Heel attachment mechanism 444 may include any suitable structure and/or device configured to releasably secure the heel portion to the sole. For example, one or more of the heel attachment mechanisms described in Section A, B, C, or D may be used with shoe 400. In this example, heel attachment mechanism 444 includes a heel receiver 446 attached to sole 402. Heel receiver 446 may be affixed to sole 402 using any suitable method (e.g., by an adhesive), and in this example is formed as a part of sole 402 (e.g., as a downward-extending part of outsole portion 414).

Specifically, heel receiver 446 includes a fixed hook portion 448 which extends from a base 449 of the heel receiver, a movable hook portion 450 disposed opposite the fixed hook portion, and an actuator 452 configured to move the movable hook portion between a retracted position and an extended position. As shown in the drawings, a wedge 472 for insertion into a corresponding recess of the heel portion (described below) extends from heel receiver 446 between fixed hook portion 448 and movable hook portion 450. This is in contrast to the recess of heel receiver 346, described above.

Furthermore, in some examples (see FIG. 36) a recess 492 is formed in an upper side of outsole portion 414, e.g., to reduce material usage. Recess 492 is capped by a cover plate 494, which may comprise a same material as the outsole or any other suitable material.

As with other shoes described herein, hook portions 448 and 450 may be oriented in any direction. Here, as in shoe 100 and 300, fixed hook portion 448 faces toward the rear, and movable hook portion 450 faces toward the front of the shoe. Movable hook portion 450 is biased toward the extended, or forward, position. Any suitable biasing device may be used (see below).

Actuator 452 is operatively connected to movable hook portion 450, such that operation (e.g., manual operation) of actuator 452 against the force of the biasing device causes the movable hook to retract. In this embodiment, actuator 452 is of a single piece with movable hook portion 450. Specifically, the combined movable hook portion 450 and actuator 452 includes a generally triangular manual handle 424, textured for enhanced grippability, as well as an elongate body 426 on which is formed a hook 428 and an integral spring member 454. Manual handle 424 is exposed on the underside of the shoe, and accessible by the user.

Body 426 has a generally planar top, configured to slide while in contact with an underside of the outsole. A rear portion of the body is received into a cavity 430 formed in heel receiver 446, such that spring member 454 is disposed in cavity 430, and is in contact with a wall of the cavity. In this example, spring member 454 is substantially as described with respect to spring member 354, and therefore includes a plurality of resilient fingers or protrusions extending generally sideways or laterally across the rear of body 426, such that distal ends of the resilient fingers are spaced from the rear of the body.

Actuator 452 and movable hook 450 are guided and retained against outsole portion 414 by a pair of side guides 456 and a retainer bar 458, although any suitable retainer/guide mechanism may be utilized.

Heel portions 404 and 406 each include an upper mounting surface 460, 462 for attaching the heel portion to the heel receiver. Each of these upper mounting surfaces includes a first recess 464, 466 configured to engage fixed hook portion 448 and a second recess 468, 470, configured to engage movable hook portion 450, such that, when the heel portion is engaged with the heel receiver, the heel portion is secured to the heel receiver when the movable hook portion is in the extended position and the heel portion is releasable from the heel receiver when the movable hook portion is in the retracted position. Recesses 464 and 466 form corresponding lips 476A, 478A of heel portion 404, and lips 476B, 478B, of heel portion 406 (see FIGS. 41 and 42).

Each of upper mounting surfaces 460 and 462 further includes a wedge receiver 432, 434. Each of these wedge receivers is configured to snugly mate with wedge 472 of the heel receiver. Specifically, installing a heel portion onto the heel receiver causes wedge 472 to mate with recess 432 or 434, adding further security and stability to the heel-shoe connection.

In operation, shoe 400 may be converted between two or more interchangeable heels as substantially as described above, with respect to shoe 300. FIG. 39 shows how the various components relate to each other when high heel portion 404 is installed on shoe 400.

F. Sixth Illustrative Convertible Shoe

As shown in FIGS. 40-45, this section describes an illustrative convertible shoe 500. Shoe 500 is another example of the convertible shoe described in the Overview above, and may be considered a variation of shoe 400, as further described below.

Figure 40:
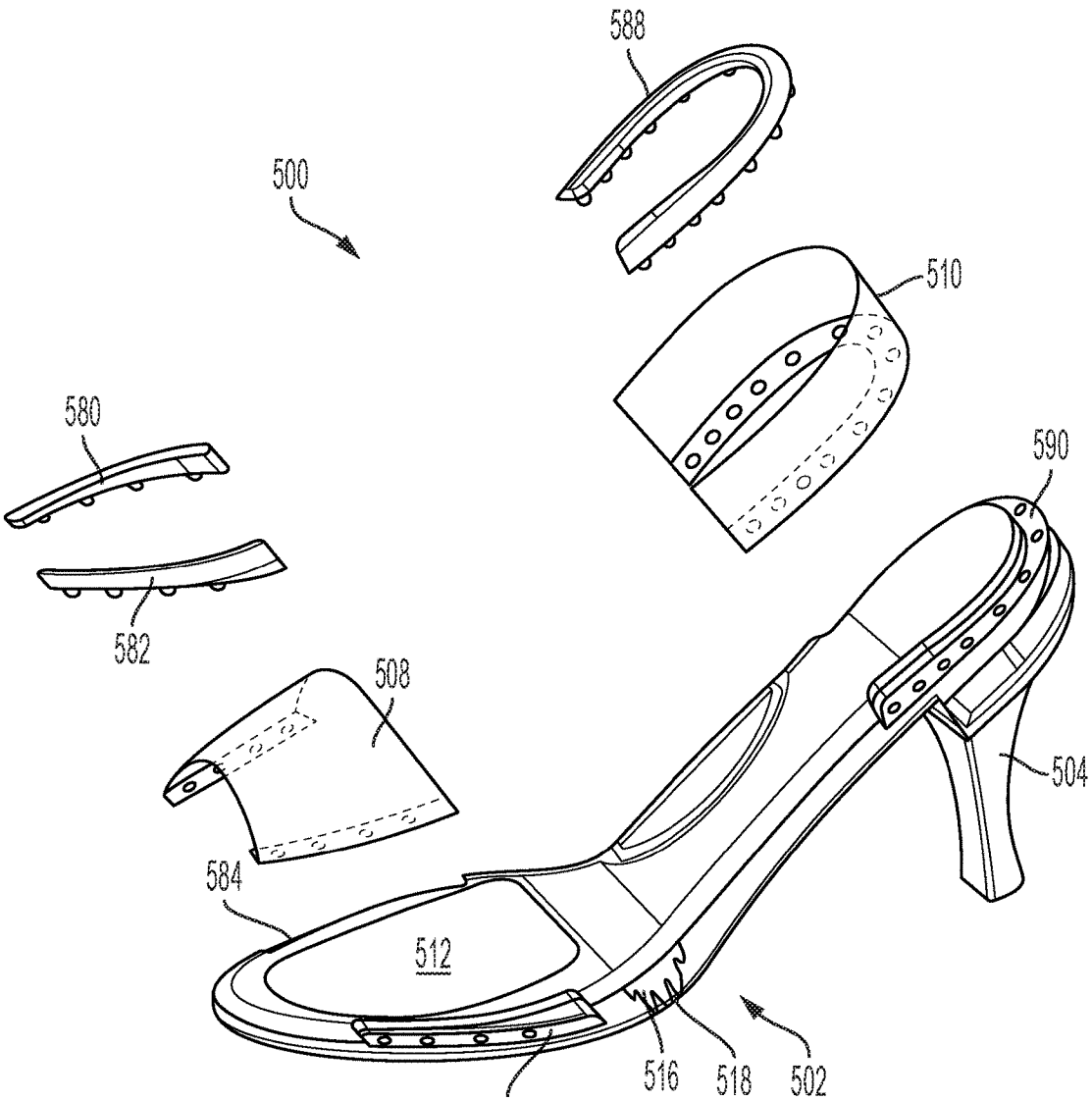
FIG. 40 is a partially exploded view of another illustrative convertible shoe.

FIG. 40 is a partially exploded isometric view of shoe 500. As with shoe 400, shoe 500 includes a sole 502 and a number of interchangeable heel portions that are releasably securable to the sole. In the present example, shoe 500 includes a high heel portion 504 and a low heel portion 506 (see FIGS. 43-45), also referred to as a tall heel portion and a short heel portion, respectively. Shoe 500 may also include an upper, as described above with respect to shoe 1, having suitable portions configured to hold the shoe on a foot of the user. For example, shoe 500 may include a toe strap 508 and a heel strap 510.

Figure 43:
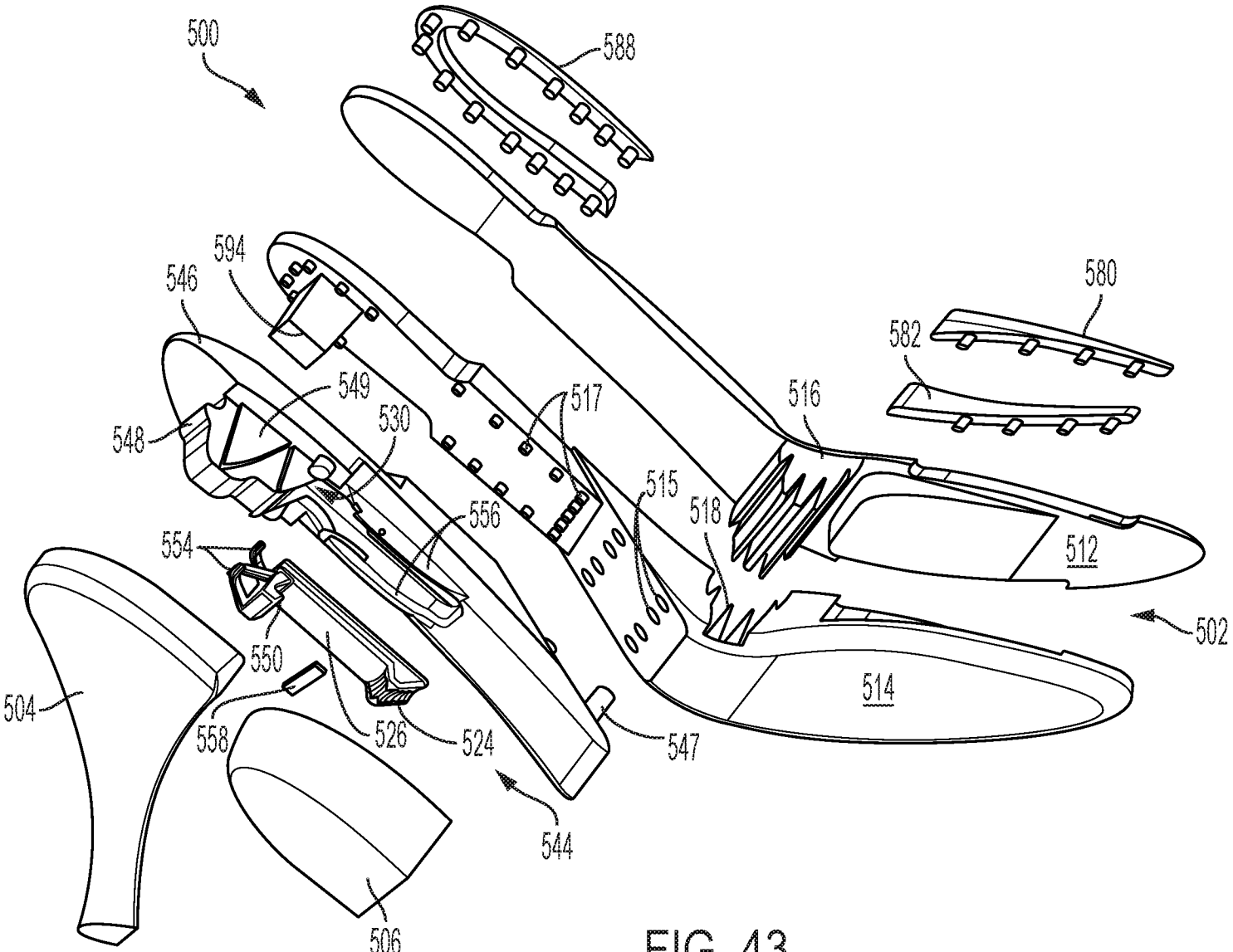
FIG. 43 is a first exploded isometric view of the shoe of FIG. 40.

Sole 502 includes an insole portion 512 generally layered atop an outsole portion 514 (see FIG. 43). As described above, the insole portion and outsole portion may each comprise any suitable materials, such as varieties of thermoplastic polyurethane (TPU). In general, outsole portion 514 may include a tougher, less resilient material than insole portion 512, e.g., for wear-resistance. Insole portion 512 may include a softer, more resilient material than outsole portion 514, e.g., for comfort. For example, outsole portion 514 may include a more rigid TPU than insole portion 512, such that chemically speaking the TPU of the outsole has a greater ratio of hard to soft segments than the TPU of the insole. Insole portion 512 may be referred to as a soft sole. In some examples, sole 502 may include more or fewer layers than the two layers described in this example. Hardness examples of various portions of shoe 500 are discussed in more depth below.

As with other shoes described herein, namely shoes 300 and 400, portions of the upper may be secured to sole 502 by one or more clamp plates. For example, toe strap 508, heel strap 510, and/or other components are secured to sole 502 by one or more clamp plates. As shown in FIG. 40, clamp plates 580, 582 and corresponding recessed clamp plate receivers 584, 586 are utilized on a front (i.e., toe) end of the sole. Each clamp plate 580, 582 includes a plurality of pins and/or other suitable protrusions configured to pass through corresponding apertures in toe strap 508. In some examples, clamp plates 580 and 582 may be crescent-shaped. The pins are further configured to mate with receiving holes in the corresponding clamp plate receivers 584 and 586 to secure the toe strap to the shoe.

Similarly, clamp plate 588 and corresponding recessed clamp plate receiver 590 are utilized on a rear (i.e., heel) end of the sole. Clamp plate 588 includes a plurality of pins and/or other suitable protrusions configured to pass through corresponding apertures in heel strap 510. The pins are further configured to mate with receiving holes in clamp plate receiver 590, which is disposed at a heel end of the sole.

In this example, clamp plate 588 is substantially C-shaped and configured to circumferentially conform to at least a portion of the heel end of the sole. This configuration enables the attachment of a closed-back upper (e.g., heel strap 510).

In addition to the clamp plates and receivers, the attachment of an upper to sole 502 may include the use of bonding, adhesive, and/or any other suitable fasteners. For example, one or more of the clamp plates may be attached to the corresponding receiver(s) by adhesive as well as by the pins and receiving holes described above.

In addition to securing the upper to sole 502, clamp plates and receivers may increase the stability of the layered sole by preventing lateral movement of the layers relative to each other. In other words, by extending into the holes of the receiver, e.g., in a friction fit, the pins of the clamp plate prevent movement orthogonal to the length of the pins.

In some examples, a single clamp plate and/or a single clamp plate receiver are disposed at a toe portion of the shoe. That is, a single plate may be used instead of the pair of plates 580, 582, and/or a single receiver may be used instead of receivers 584, 586. Additionally, or alternatively, two or more clamp plates and/or two or more receivers may be used at a heel portion of the shoe in place of plate 588 and receiver 590.

Figure 41:
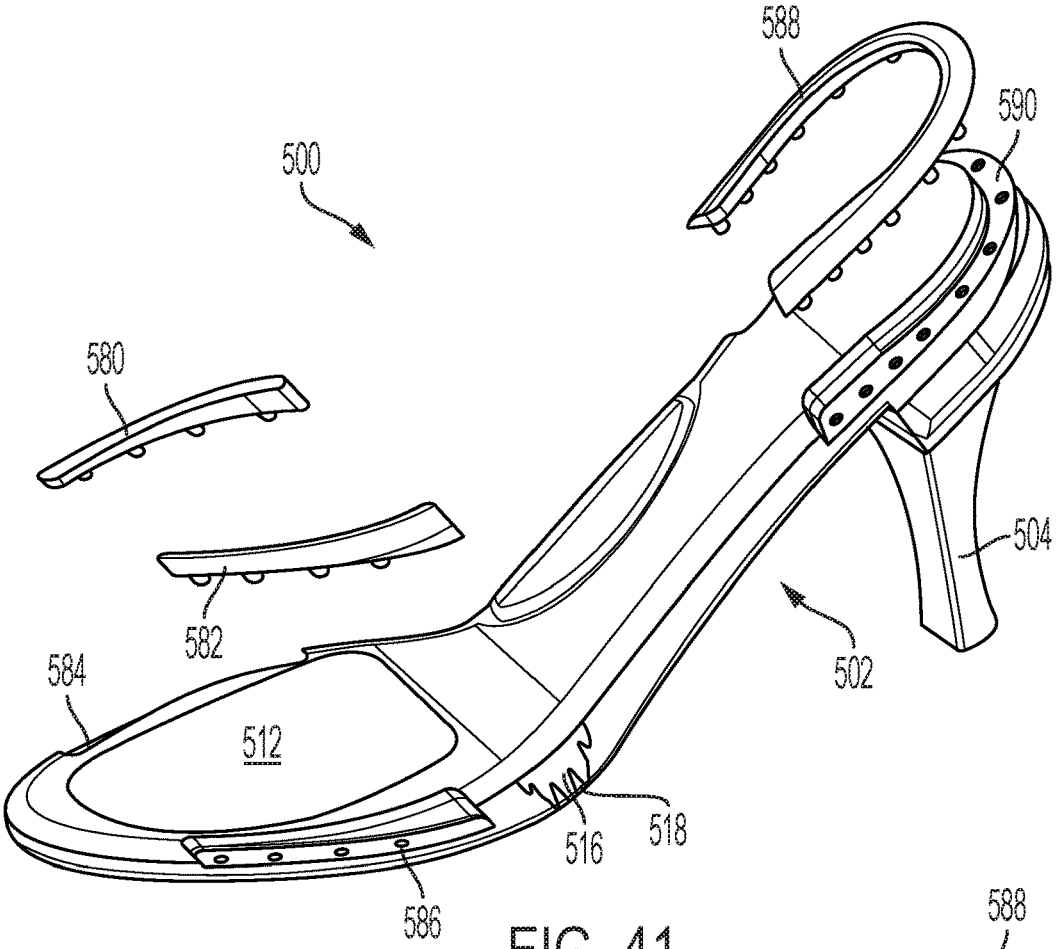
FIG. 41 is a partially exploded view of the shoe of FIG. 40, showing clip portions aligned with corresponding receivers.

FIG. 41 depicts shoe 500 having clamp plates 580, 582, and 588 in an unattached configuration. Clamp plate receivers 584, 586, and 590 are each disposed in a respective recess of sole 502. In this example, clamp plate receivers 584 and 586 are disposed on an upper surface of outsole 514. Insole 512 has corresponding cutouts formed on peripheral edges of the insole to allow clamp plates 580 and 582 to mate with clamp plate receivers 584 and 586, such that top surfaces of the clamp plates lie substantially flush with a top surface of the insole (see FIG. 42).

Similarly, clamp plate receiver 590 is recessed in sole 502. In this example, clamp plate receiver 590 is formed as part of a heel attachment mechanism 544, described in more depth below and depicted in FIGS. 43 and 44. Insole 512 and outsole 514 each have a peripheral cutout (AKA carveout) on the heel side to accommodate clamp plate 588, such that the top surface of clamp plate 588 lies substantially flush with a top surface of insole 512 when the clamp plate is attached to clamp plate receiver 590.

Figure 42:
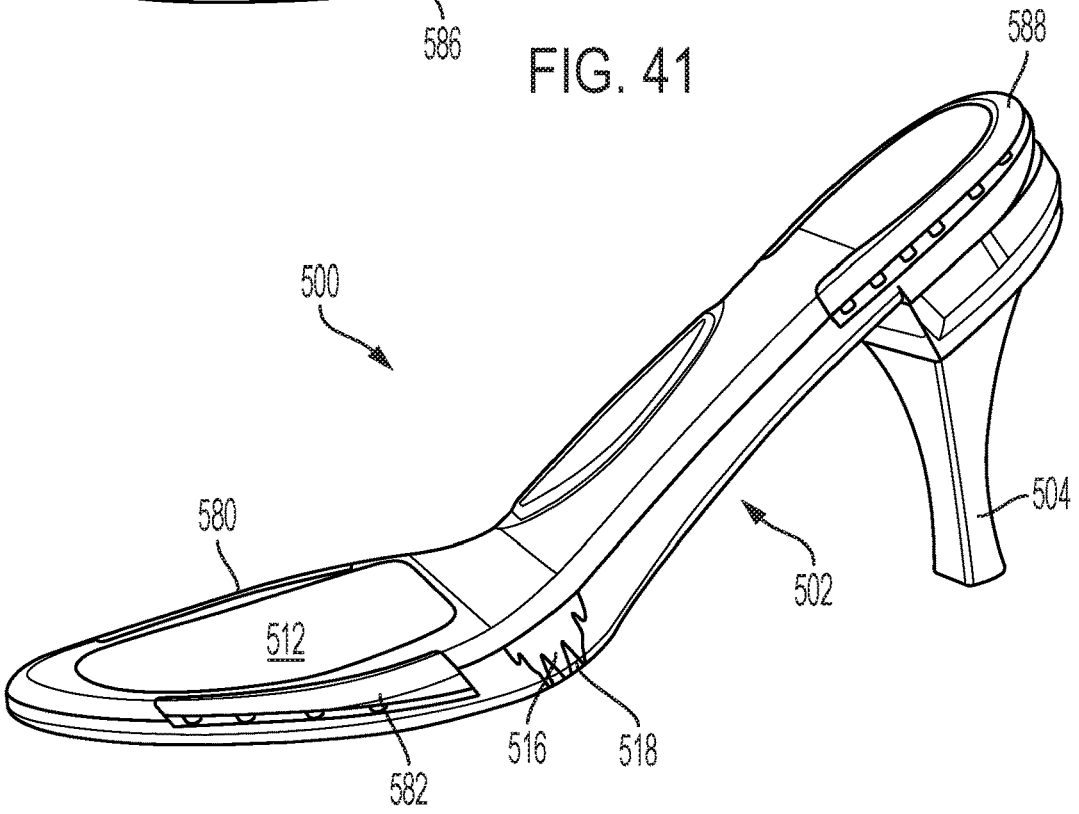
FIG. 42 is a partially assembled view of the shoe of FIG. 40, showing the clip portions inserted into the receivers.

As shown in FIG. 42, when clamp plates 580, 582, and 588 are attached to their corresponding clamp plate receivers, gaps are formed between the bottom surfaces of the clamp plates and the corresponding top surfaces of the clamp plate receivers to accommodate portions of an upper. The length of the protrusions of the clamp plates may be selected such that the gaps are configured to accommodate an upper of a desired thickness. For example, the gaps may be configured to accommodate an upper comprising leather, vinyl, fabric, and/or any other suitable material. In some examples, the protrusions are shorter than the depth of the corresponding receiver holes. This may facilitate an increased clamping capacity.

In this example, insole portion 512 includes an extension or enlargement in the form of a ridged or toothed cushion 516 disposed in a region of the insole where a user's metatarsophalangeal (MTP) joints (i.e., the heads of the metatarsal bones) would typically exert pressure. Cushion 516 may comprise the relatively soft and/or resilient material of insole portion 512, and may be unitary with the insole portion. As depicted in this example, cushion 516 mates with (i.e., is received by) a corresponding cushion receiver 518 disposed in outsole portion 514. Cushion receiver 518 includes complementary ridges or teeth configured to engage the teeth of cushion 516 for security and resilience. Accordingly, as with shoe 400, a thicker portion of the insole extends into a recess of the outsole in a region of the sole corresponding to metatarsophalangeal joints of a user.

Figure 44:
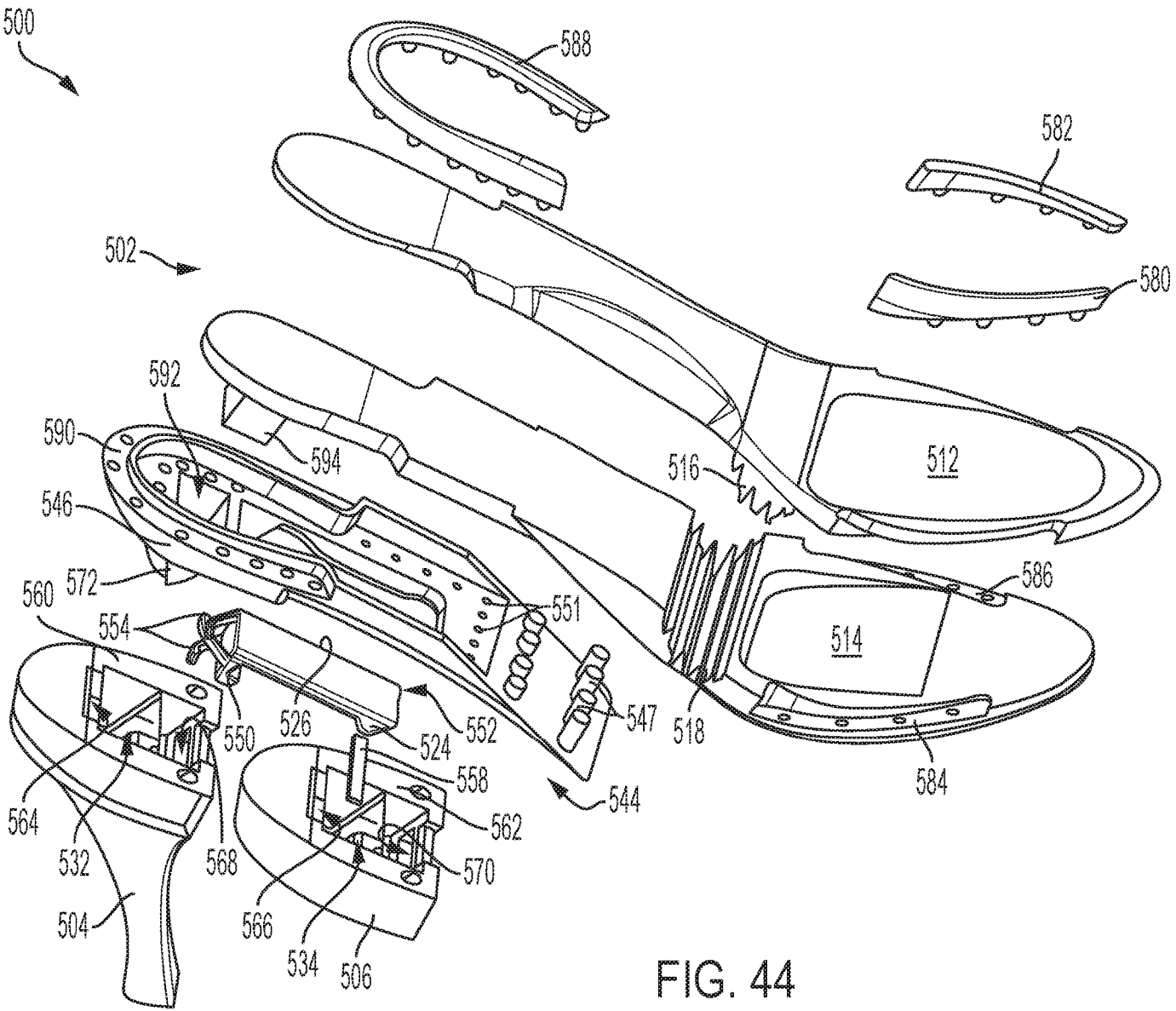
FIG. 44 is a second exploded isometric view of the shoe of FIG. 40.

As shown in FIGS. 43-44, a heel attachment mechanism 544 is included in shoe 500. Heel attachment mechanism 544 may include any suitable structure and/or device configured to releasably secure a heel portion to the sole. For example, one or more of the heel attachment mechanisms described in Sections A, B, C, D, and/or E may be used with shoe 500.

In this example, heel attachment mechanism 544 includes a heel receiver 546 (AKA a hard sole or hard rear portion). Heel receiver 546 may be affixed to sole 502 using any suitable fastener (e.g., by an adhesive). In this example, heel receiver 546 is affixed to outsole 514 by a plurality of pins or protrusions 547 formed in heel receiver 546 and configured to mate with receiving holes 515 in outsole 514. Additionally, to increase security, outsole 514 has a plurality of pins or protrusions 517 configured to mate with receiving holes 551 in heel receiver 546. The inclusion of protrusions 547 and 517 and holes 551 and 515 on heel receiver 546 and outsole 514 increases the robustness of heel attachment mechanism 544 and enables shoe 500 to withstand the forces involved with standing and walking for prolonged times without failure of the heel portions or heel receiver.

Furthermore, in this example, a recess 592 is formed in an upper surface of heel receiver 546. A corresponding block 594 is formed on or coupled to a bottom surface of outsole 514. Block 594 is configured to mate with recess 592, thereby further increasing the security of heel receiver 546.

Figure 45:
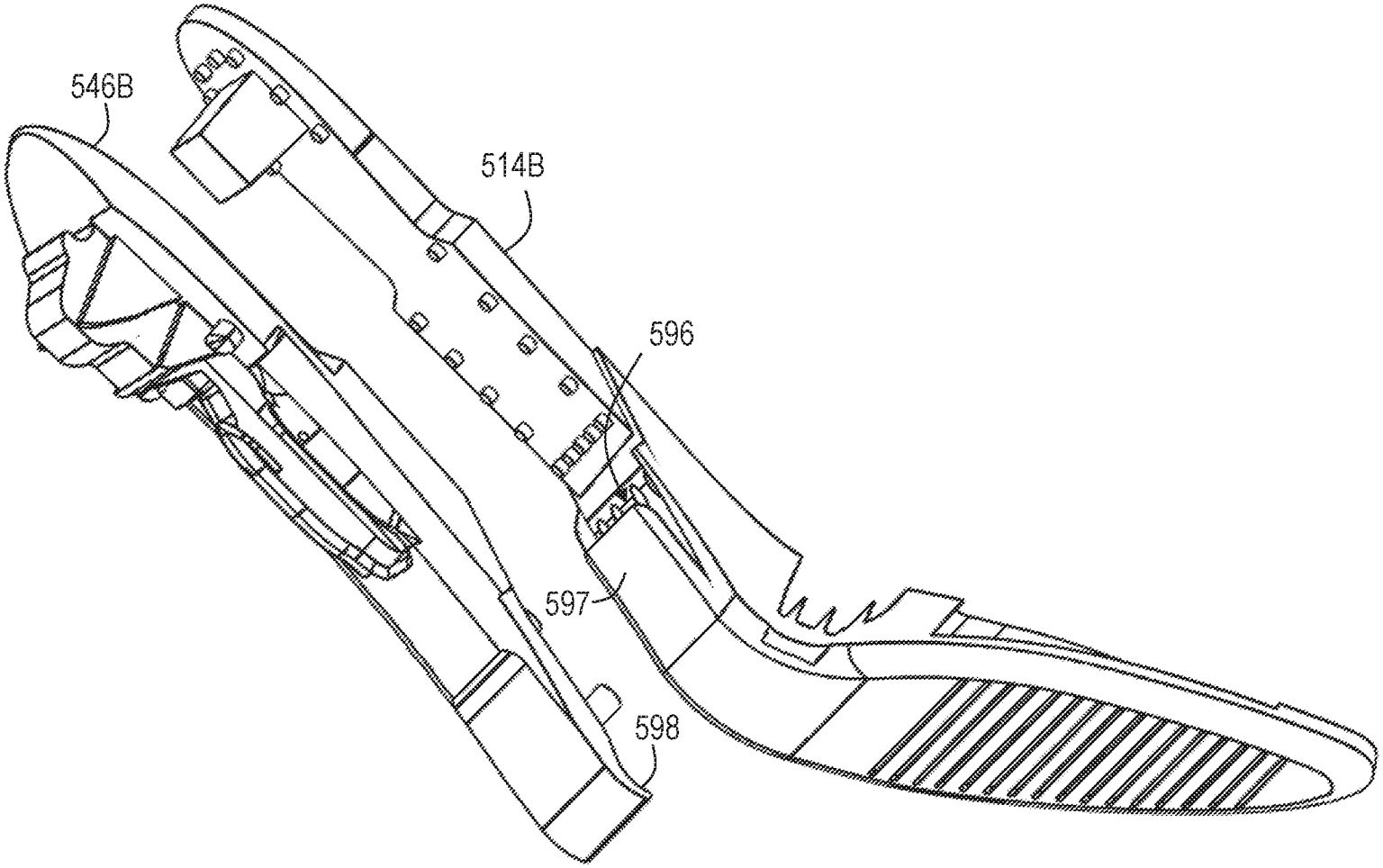
FIG. 45 is an exploded isometric view of an outsole and a heel receiver suitable for use with shoes of the present disclosure.

Alternate embodiments of the outsole and heel receiver, namely heel receiver 546B and outsole 514B, are depicted in FIG. 45. Outsole 514B and heel receiver 546B may be substantially similar to outsole 514 and heel receiver 546, respectively, except for the differences described below. The features of heel receiver 546B and outsole 514B may be included in shoe 400 and/or shoe 500.

Outsole 514B includes a slot or space 596 configured to accommodate an extension or tongue portion 598 of heel receiver 546B. Outsole 514B additionally includes a protective cover 597 proximate space 596 configured to cover the interface between outsole 514B and heel receiver 546B. This configuration provides increased rigidity in the bottom of shoe 500, e.g., to further withstand the forces involved with prolonged standing and walking. Tongue portion 598 may include a curved section configured to follow the curve of shoe 500 below the region where the user's MTP joints typically exert pressure. The curved section allows for tongue portion 598 to extend further towards the toe-end of shoe 500 and accommodate the general curve of sole 502.

When assembled, heel receiver 546B interlocks with outsole 514B such that tongue portion 598 is received by and housed within space 596.

Returning to FIGS. 43 and 44, as with shoe 400, heel receiver 546 includes a fixed hook portion 548 which extends from a base 549 of the heel receiver, a movable hook portion 550 disposed opposite the fixed hook portion, and an actuator 552 configured to move the movable hook portion between a retracted position and an extended position. As shown in the drawings, a wedge 572 extends from heel receiver 546 between fixed hook portion 548 and movable hook portion 550. Wedge 572 may have one or more protrusions formed as triangular prisms disposed on outboard sides of the wedge to increase rigidity and decrease lateral motion of the heel portion (e.g., when the wedge is received in a corresponding recess of the heel portion, described below).

As with other shoes described herein, hook portions 548 and 550 may be oriented in any suitable direction. Here, as in shoe 100, 300, and 400, fixed hook portion 548 faces toward the rear portion of the shoe, and movable hook portion 550 faces toward the front of the shoe. Movable hook portion 550 is biased toward the extended (e.g., forward) position. Any suitable biasing device may be used (see below).

Actuator 552 is operatively connected to movable hook portion 550, such that operation (e.g., manual operation) of actuator 552 against the force of the biasing device causes the movable hook to retract. In this embodiment, actuator 552 is of a single piece with movable hook portion 550. Specifically, the combined movable hook portion 550 and actuator 552 includes a generally triangular manual handle 524, textured for enhanced grippability, as well as an elongate body 526 on which is formed a hook 528 and an integral spring member 554. Manual handle 524 is exposed on the underside of the shoe, and accessible by the user.

Body 526 has a generally planar top, configured to slide while in contact with an underside of the outsole. A rear portion of body 526 is received in a cavity 530 formed in heel receiver 546, such that spring member 554 is disposed in cavity 530, and is in contact with a wall of the cavity. In this example, spring member 554 is substantially as described above with respect to spring member 454. For example, spring member 554 includes a plurality of resilient fingers or protrusions extending generally sideways (e.g., laterally) across the rear of body 526, such that distal ends of the resilient fingers are spaced from the rear of the body.

Actuator 552 and movable hook 550 are guided and retained against outsole portion 514 by a pair of side guides 556 and a retainer bar 558, although any suitable retainer/guide mechanism may be utilized.

Heel portions 504 and 506 include respective upper mounting surfaces 560, 562 for attaching the respective heel portion to heel receiver 546. Upper mounting surface 560 includes a first recess 564 configured to engage fixed hook portion 548, and a second recess 568, configured to engage movable hook portion 550. Similarly, upper mounting surface 562 includes a first recess 566 configured to engage fixed hook portion 548, and a second recess 570 configured to engage movable hook portion 550. Accordingly, heel portion 504 or 506 is secured to the heel receiver when the movable hook portion is in the extended position. The heel portion is releasable from the heel receiver when the movable hook portion is in the retracted position.

Each of upper mounting surfaces 560 and 562 further includes a respective wedge receiver 532, 534. Each of these wedge receivers is configured to snugly mate with wedge 572 of the heel receiver. Specifically, installing heel portion 504 or 506 onto the heel receiver causes wedge 572 to mate with receiver 532 or 534, adding further security and stability to the heel-shoe connection.

In operation, shoe 500 may be converted between two or more interchangeable heels (e.g., heel portions 504, 506) substantially as described above with respect to shoe 300 and shoe 400.

Figure 46:
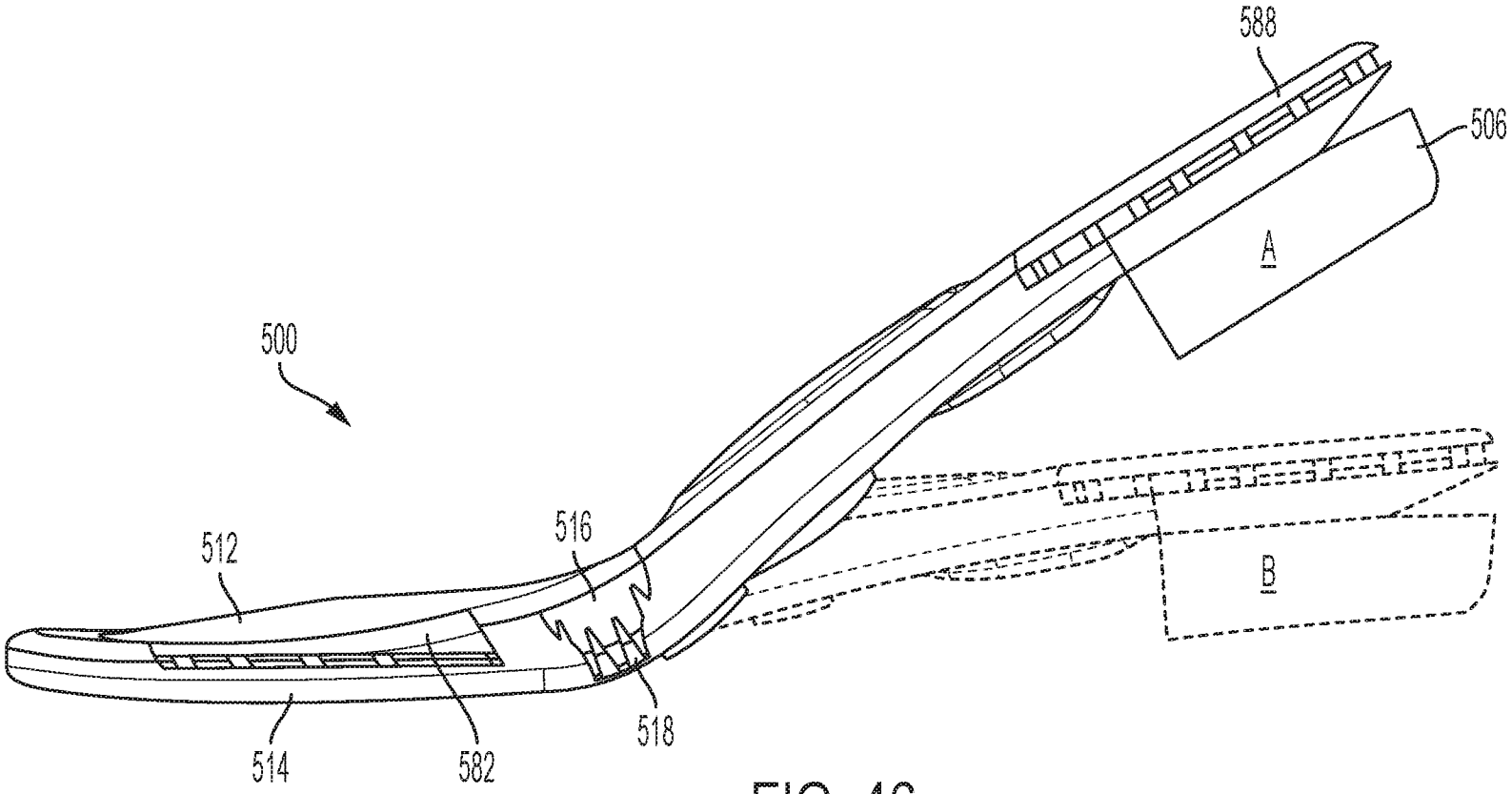
FIG. 46 is a side view of the shoe of FIG. 40 depicting two positions of the shoe.

Turning now to FIG. 46, shoe 500 is configured to be transitionable between first (raised heel) and second (lowered heel) states A and B. In first state A, shoe 500 has a first shape or configuration, and in second state B, shoe 500 has a second shape or configuration. The first shape is generally more curved or bent than the second shape. As shown in FIG. 45, shoe 500 in the first shape (state A) curves and/or bends at a bending region disposed at a generally midfoot portion of the sole (e.g., near adjacent a user's MTP joints, and/or at any other suitable part of the shoe). In the first shape the sole is bent at an obtuse angle such that the sole is divided into a generally planar toe portion and a generally planar heel portion. In the second shape (state B), shoe 500 has a less curved and/or substantially flat shape, as shown in dashed lines in FIG. 45.

Sole 502 is formed in a particular configuration to bias shoe 500 toward state A, such that sole 502 has a shape memory of state A. In other words, state A is a default state of the sole, and sole 502 comprises suitable resilient material(s) in suitable configuration(s) for urging the shoe into or toward state A if displaced. For example, the layers of sole 502 may be formed (e.g., 3D printed, extruded, etc.) in the bent configuration of state A, with materials of differing hardness (and therefore resilience). In some examples, the following materials (or the like) may be used: heel receiver 546 may be formed with TPU having a hardness (i.e., Shore durometer) of 90D, outsole portion 514 may be formed with TPU having a hardness of 80A, and insole portion may be formed with TPU having a hardness of 35A. This layering of softer materials onto harder materials imparts an overall resilience to sole 502, biasing the sole to state A.

If a downward force flattens sole 502 with respect to state A, the configuration of the resilient layers urges the sole back to state A. Additionally, the plurality of pins or protrusions securing the layers of sole 502 to each other restricts the layers from sliding or shifting with respect to each other, thereby building tension (e.g., in the form of elastic and/or shear strain) in the plurality of pins or protrusions when the sole is deformed from state A. The tension built in the plurality of pins or protrusions compliments the resilience of the material, further biasing shoe 500 back toward state A.

The natural resting state (state A) of sole 502 corresponds to the high-heeled configuration of shoe 500 described above, even when the shoe is in the low-heeled configuration. In other words, the bend/curve of the sole at the generally midfoot portion corresponds to the natural shape of the sole in the high-heeled configuration. Any downward force on the sole while in the high-heeled configuration is countered by an upward force from high heel portion 504, thereby maintaining shoe 500 in state A. When shoe 500 is transitioned to the low-heeled configuration (i.e., when low heel portion 506 is attached), sole 502 remains biased to maintain state A.

Shoe 500 can be forced from state A to state B by a suitable force or pressure. For example, if a toe portion of shoe 500 is held in a fixed position (e.g., between a wearer's foot and the ground), a sufficient downward force applied to sole 502 to the rear of the bending region (e.g., by the wearer's heel) causes the shoe to assume state B. In the absence of such a downward force (e.g., if the wearer's heel is lifted), the resiliency (e.g., bias) of sole 502 urges shoe 500 from state B to state A. In the context of a walking gait, first state A corresponds to a state of shoe 500 after a user has released the downward force of their foot, such as during a swing phase of the gait (e.g., when the shoe is spaced from the ground). Second state B corresponds to a state of shoe 500 while a user presses down on a rear or midfoot portion of the shoe (i.e., applying a downward force with at least their heel), such as during a stance phase of the gait. As the user walks, each foot typically alternates between the swing phase and the stance phase, thereby causing shoe 500 to alternate between state A and state B.

In a typical walking gait, an initial contact phase (i.e., heel strike) of the gait occurs when the heel strikes the ground and begins a rotational transition to a mid-stance of the stance phase. In mid-stance, a bottom surface of the heel of shoe 500 and the ground-contacting, toe-end bottom surface of outsole 514 are substantially coplanar with the ground. During the transition from initial contact to mid-stance, sole 502 of shoe 500 transitions (e.g., at least partially flattens) from state A to state B. During this transition, the bottom surface of the user's foot remains in contact with the top surface of insole 512 (e.g., as the foot pushes the sole toward the ground).

As the user continues through the walking gait (i.e., during the swing phase and heel strike of the contralateral leg), a corresponding transition from mid-stance to a terminal stance occurs. The transition from mid-stance to terminal stance corresponds to the user shifting their center of mass forward and lifting their heel from the ground. During this transition, shoe 500 transitions from state B to state A as the heel of the shoe lifts from the ground, due to the resilience of sole 502. The toe-end of outsole 514 remains planted on the ground. The spring-bias of sole 502 allows the bottom surface of the user's foot to remain in contact with the top surface of insole 512. Said another way, the spring-bias of sole 502 automatically causes the top surface of insole 512 to remain substantially in contact with the user's foot, as opposed to simply flapping up and down in a hinging action.

Shoe 500 remains in state A during the entirety of the swing phase of the gait (i.e., while the user's foot is lifted off the ground), before the heel strikes the ground again (i.e., during the next stride's initial contact). This transition between state A and state B while walking advantageously provides continuous contact between the bottom of the user's foot and shoe 500. Due to the resilience of sole 502, this continuous contact occurs even in the absence of a heel-end upper, for example heel strap 510. Common examples of a shoe having only a toe-end upper are sandals, flip flops, etc. In known examples of footwear having no heel-end upper, as a user walks, the heel end of the shoe separates from the user's foot as they step forward. In contrast, the bias of shoe 500 toward state A enables the bottom of the user's foot to remain in continuous contact with the shoe during walking, even in the absence of a heel-end upper.

G. Illustrative Combinations and Additional Examples

This section describes additional aspects and features of convertible footwear of the present teachings, presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A0. An article of footwear, comprising:

a sole having an insole and an outsole, and an outer layer on a rear portion of the outsole, wherein the outer layer is not present on a toe portion of the outsole, and wherein the outer layer is more rigid than the outsole; and an upper clamped to the sole by one or more clamp plates, wherein each of the one or more clamp plates includes first mating features configured to mate with corresponding second mating features in the sole via corresponding apertures in the upper.

A1. The article of footwear of A0, wherein the outer layer comprises a heel receiver having a fixed hook portion and a movable hook portion, the article of footwear further comprising a first heel portion and a second heel portion, each having a first recess configured to engage the fixed hook portion and a second recess configured to engage the movable hook portion, such that the article of footwear is transitionable between a first configuration, in which the first heel portion is secured to the heel receiver of the sole, and a second configuration, in which the second heel portion is secured to the heel receiver of the sole.

A2. The article of footwear of A0 or A1, wherein the insole further comprises a ridged cushion received by a complementary ridged portion of the outsole forward of the outer layer of the outsole.

A3. The article of footwear of any one of paragraphs A0 through A2, wherein the outsole and outer layer are coupled to each other at least in part by a plurality of pins oriented transverse to the outsole.

A4. The article of footwear of any one of paragraphs A0 through A3, wherein a front end of the outer layer includes a tongue inserted into a corresponding slot of the outsole.

A5. The article of footwear of any one of paragraphs A0 through A4, wherein the outer layer comprises a material having a Shore durometer of 90D, the outsole has a Shore durometer of 80A, and the insole has a Shore durometer of 35A.

A6. The article of footwear of any one of paragraphs A0 through A5, wherein the insole and the outsole comprise a thermoplastic polyurethane (TPU).

A7. The article of footwear of any one of paragraphs A0 through A6, wherein the sole is bent at an obtuse angle dividing the sole into a generally planar toe portion and a generally planar heel portion, and the sole is resiliently biased toward the obtuse angle.

A8. The article of footwear of any one of paragraphs A0 through A7, wherein the one or more clamp plates include a U-shaped heel clamp plate configured to fit into a corresponding U-shaped recess in a heel end of the sole, such that a top surface of the heel clamp plate is flush with a top surface of the sole.

A9. The article of footwear of A8, wherein the recess in the heel end of the sole is formed by a carveout on a rear contour of the insole and outsole, such that a rear contour of the outer layer extends farther rearward than the insole and outsole.

A10. The article of footwear of any one of paragraphs A0 through A9, wherein the one or more clamp plates include a pair of crescent-shaped clamp plates configured to fit into corresponding lateral recesses at a toe end of the sole, such that the pair of crescent shaped clamp plates secure a front portion of the upper to the sole.

A11. The article of footwear of any one of paragraphs A0 through A10, wherein the first mating features comprise a plurality of pins protruding from the one or more clamp plates, and the second mating features comprise a corresponding number of holes in the sole.

B0. A method of manufacturing an article of footwear, the method comprising:

aligning first apertures of an upper with corresponding first mating features of a sole;

clamping the upper to the sole using a clamp plate, wherein the clamp plate includes second mating features configured to mate with the first mating features through the apertures of the upper.

B1. The method of B0, wherein the first mating features are female and the second mating features are male.

B2. The method of B0 or B1, wherein the first mating features comprise a number of recesses, and the second mating features comprise a same number of pins.

B3. The method of any one of paragraphs B0 through B2, further comprising securing the first and second mating features to each other using an adhesive.

B4. The method of any one of paragraphs B0 through B3, wherein the clamp plate fits into a recess of the sole shaped to receive the clamp plate, such that a top surface of the clamp plate is flush with a top surface of the sole.

B5. The method of any one of paragraphs B0 through B4, wherein the upper comprises a heel portion and a toe strap portion, the method further comprising clamping the heel portion and the toe strap portion to the sole using different clamp plates.

B6. The method of any one of paragraphs B0 through B5, wherein the first and second mating features are configured to mate using a friction fit.

B7. The method of any one of paragraphs B0 through B6, wherein the second mating features of the clamp plate are spaced from each other and extend around a periphery of a heel end of the sole.

Advantages, Features, and Benefits

The different embodiments and examples of the convertible footwear described herein provide several advantages over known solutions. For example, illustrative embodiments and examples described herein allow simple and secure interchange of different-height heels.

Additionally, and among other benefits, illustrative embodiments and examples described herein automatically reposition and/or secure a position of a support shank relative to the sole of the footwear as a result of replacing one heel with another.

Additionally, and among other benefits, illustrative embodiments and examples described herein allow conversion between a high heel and a low heel without the need for tools.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. An article of footwear, comprising:

a sole having an insole and an outsole, and an outer layer on a rear portion of the outsole, wherein the outer layer is not present on a toe portion of the outsole, and wherein the outer layer is more rigid than the outsole; and an upper clamped to the sole by one or more clamp plates, wherein each of the one or more clamp plates includes first mating features configured to mate with corresponding second mating features in the sole via corresponding apertures in the upper;

wherein the one or more clamp plates include a U-shaped heel clamp plate configured to fit into a corresponding U-shaped recess in a heel end of the sole, such that a top surface of the heel clamp plate is flush with a top surface of the sole.

2. The article of footwear of claim 1, wherein the outer layer comprises a heel receiver having a fixed hook portion and a movable hook portion, the article of footwear further comprising a first heel portion and a second heel portion, each having a first recess configured to engage the fixed hook portion and a second recess configured to engage the movable hook portion, such that the article of footwear is transitionable between a first configuration, in which the first heel portion is secured to the heel receiver of the sole, and a second configuration, in which the second heel portion is secured to the heel receiver of the sole.

3. The article of footwear of claim 1, wherein the insole further comprises a ridged cushion received by a complementary ridged portion of the outsole forward of the outer layer of the outsole.

4. The article of footwear of claim 1, wherein the outsole and outer layer are coupled to each other at least in part by a plurality of pins oriented transverse to the outsole.

5. The article of footwear of claim 1, wherein a front end of the outer layer includes a tongue inserted into a corresponding slot of the outsole.

6. The article of footwear of claim 1, wherein the outer layer comprises a material having a Shore durometer of 90D, the outsole has a Shore durometer of 80A, and the insole has a Shore durometer of 35A.

7. The article of footwear of claim 1, wherein the insole and the outsole comprise a thermoplastic polyurethane (TPU).

8. The article of footwear of claim 1, wherein the sole is bent at an obtuse angle dividing the sole into a generally planar toe portion and a generally planar heel portion, and the sole is resiliently biased toward the obtuse angle.

9. The article of footwear of claim 1, wherein the recess in the heel end of the sole is formed by a carveout on a rear contour of the insole and outsole, such that a rear contour of the outer layer extends farther rearward than the insole and outsole.

10. The article of footwear of claim 1, wherein the one or more clamp plates include a pair of crescent-shaped clamp plates configured to fit into corresponding lateral recesses at a toe end of the sole, such that the pair of crescent shaped clamp plates secure a front portion of the upper to the sole.

11. The article of footwear of claim 1, wherein the first mating features comprise a plurality of pins protruding from the one or more clamp plates, and the second mating features comprise a corresponding number of holes in the sole.

12. A method of manufacturing an article of footwear, the method comprising:

aligning first apertures of an upper with corresponding first mating features of a sole;

clamping the upper to the sole using one or more clamp plates, wherein the one or more clamp plates includes second mating features configured to mate with the first mating features through the apertures of the upper; and wherein the one or more clamp plates include a U-shaped heel clamp plate configured to fit into a corresponding U-shaped recess in a heel end of the sole, such that a top surface of the heel clamp plate is flush with a top surface of the sole.

13. The method of claim 12, wherein the first mating features are female and the second mating features are male.

14. The method of claim 12, wherein the first mating features comprise a number of recesses, and the second mating features comprise a same number of pins.

15. The method of claim 12, further comprising securing the first and second mating features to each other using an adhesive.

16. The method of claim 12, wherein each of the one or more clamp plates fit into a respective recess of the sole, such that each respective top surface of the one or more clamp plates is flush with a top surface of the sole.

17. The method of claim 12, wherein the one or more clamp plates further include a pair of crescent-shaped clamp plates configured to fit into corresponding lateral recesses at a toe end of the sole; and wherein the upper comprises a heel portion and a toe strap portion, the method further comprising clamping the heel portion to the sole using the heel clamp plate and the toe strap portion to the sole using the pair of crescent-shaped clamp plates.

18. The method of claim 12, wherein the first and second mating features are configured to mate using a friction fit.

19. The method of claim 12, wherein the second mating features are spaced from each other and extend around a periphery of a heel end of the sole.

20. An article of footwear, comprising:

a sole having an insole and an outsole, and an outer layer on a rear portion of the outsole, wherein the outer layer is not present on a toe portion of the outsole, and wherein the outer layer is more rigid than the outsole; and an upper clamped to the sole by one or more clamp plates, wherein each of the one or more clamp plates includes first mating features configured to mate with corresponding second mating features in the sole via corresponding apertures in the upper;

wherein the one or more clamp plates include a pair of crescent-shaped clamp plates configured to fit into corresponding lateral recesses at a toe end of the sole, such that the pair of crescent shaped clamp plates secure a front portion of the upper to the sole.

21. The article of footwear of claim 20, wherein the outer layer comprises a heel receiver having a fixed hook portion and a movable hook portion, the article of footwear further comprising a first heel portion and a second heel portion, each having a first recess configured to engage the fixed hook portion and a second recess configured to engage the movable hook portion, such that the article of footwear is transitionable between a first configuration, in which the first heel portion is secured to the heel receiver of the sole, and a second configuration, in which the second heel portion is secured to the heel receiver of the sole.

22. The article of footwear of claim 20, wherein the insole further comprises a ridged cushion received by a complementary ridged portion of the outsole forward of the outer layer of the outsole.

23. The article of footwear of claim 20, wherein the outsole and outer layer are coupled to each other at least in part by a plurality of pins oriented transverse to the outsole.

24. The article of footwear of claim 20, wherein a front end of the outer layer includes a tongue inserted into a corresponding slot of the outsole.

25. The article of footwear of claim 20, wherein the outer layer comprises a material having a Shore durometer of 90D, the outsole has a Shore durometer of 80A, and the insole has a Shore durometer of 35A.

26. The article of footwear of claim 20, wherein the insole and the outsole comprise a thermoplastic polyurethane (TPU).

27. The article of footwear of claim 20, wherein the sole is bent at an obtuse angle dividing the sole into a generally planar toe portion and a generally planar heel portion, and the sole is resiliently biased toward the obtuse angle.

28. The article of footwear of claim 20, wherein the one or more clamp plates include a U-shaped heel clamp plate configured to fit into a corresponding U-shaped recess in a heel end of the sole, such that a top surface of the heel clamp plate is flush with a top surface of the sole.

29. The article of footwear of claim 28, wherein the recess in the heel end of the sole is formed by a carveout on a rear contour of the insole and outsole, such that a rear contour of the outer layer extends farther rearward than the insole and outsole.

30. The article of footwear of claim 1, wherein the first mating features comprise a plurality of pins protruding from the one or more clamp plates, and the second mating features comprise a corresponding number of holes in the sole.

31. A method of manufacturing an article of footwear, the method comprising:

aligning first apertures of an upper with corresponding first mating features of a sole;

clamping the upper to the sole using one or more clamp plates, wherein the one or more clamp plates includes second mating features configured to mate with the first mating features through the apertures of the upper;

wherein the one or more clamp plates include a pair of crescent-shaped clamp plates configured to fit into corresponding lateral recesses at a toe end of the sole, and a U-shaped heel clamp plate configured to fit into a corresponding U-shaped recess in a heel end of the sole; and wherein the upper comprises a heel portion and a toe strap portion, and clamping the upper to the sole includes clamping the heel portion to the sole using the heel clamp plate and the toe strap portion to the sole using the pair of crescent-shaped clamp plates.

32. The method of claim 31, wherein the first mating features are female and the second mating features are male.

33. The method of claim 31, wherein the first mating features comprise a number of recesses, and the second mating features comprise a same number of pins.

34. The method of claim 31, further comprising securing the first and second mating features to each other using an adhesive.

35. The method of claim 31, wherein each of the one or more clamp plates fits into a respective recess of the sole, such that each respective top surface of the one or more clamp plates is flush with a top surface of the sole.

36. The method of claim 31, wherein the first and second mating features are configured to mate using a friction fit.

37. The method of claim 31, wherein the second mating features are spaced from each other and extend around a periphery of a heel end of the sole.

* * * * *